US006475601B1

(12) United States Patent
Sakaki et al.

(10) Patent No.: US 6,475,601 B1
(45) **Date of Patent: *Nov. 5, 2002**

(54) PRINTING PAPER, AND INK-JET PRINTING PROCESS USING THE SAME

(75) Inventors: Mamoru Sakaki, Yamato; Masato Katayama, Yokohama; Mifune Hirose, Machida, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/629,751

(22) Filed: Apr. 9, 1996

(30) Foreign Application Priority Data

| | | |
|---|---|---|
| Apr. 10, 1995 | (JP) | 7-083813 |
| May 22, 1995 | (JP) | 7-145198 |
| Jul. 24, 1995 | (JP) | 7-187108 |
| Jul. 24, 1995 | (JP) | 7-187110 |
| Apr. 4, 1996 | (JP) | 8-106423 |

(51) Int. Cl.[7] ..... B41M 5/00; B41J 2/01
(52) U.S. Cl. ..... 428/195; 347/105; 428/211
(58) Field of Search ..... 428/195, 537.5, 428/174, 211, 328–331; 347/105

(56) References Cited

U.S. PATENT DOCUMENTS

| | | | | | |
|---|---|---|---|---|---|
| 4,425,405 | A | * | 1/1984 | Murakami et al. | 428/537.5 |
| 4,636,410 | A | | 1/1987 | Akiya et al. | 427/261 |
| 4,734,336 | A | * | 3/1988 | Oliver et al. | 428/537.5 |
| 4,758,461 | A | | 7/1988 | Akiya et al. | 428/212 |
| 4,965,612 | A | | 10/1990 | Sakaki et al. | 346/1.1 |
| 5,246,774 | A | | 9/1993 | Sakaki et al. | 428/323 |
| 5,294,299 | A | | 3/1994 | Zeuner et al. | 162/145 |
| 5,362,558 | A | | 11/1994 | Sakaki et al. | 428/323 |
| 5,591,514 | A | * | 1/1997 | Hirose et al. | 428/211 |

FOREIGN PATENT DOCUMENTS

| | | | | |
|---|---|---|---|---|
| CA | 2002254 | | 5/1990 | |
| DE | 3837746 | | 3/1990 | |
| EP | 0099586 | | 2/1984 | |
| EP | 0366825 | | 5/1990 | |
| FR | 2570988 | | 4/1986 | |
| JP | 51-013244 | | 2/1976 | |
| JP | 54-059936 | | 5/1979 | |
| JP | 59-035977 | | 2/1984 | |
| JP | 59-162561 | | 9/1984 | |
| JP | 59-191068 | | 10/1984 | |
| JP | 6063190 | * | 4/1985 | 428/537.5 |
| JP | 1-135682 | | 5/1989 | |
| JP | 2-243512 | | 9/1990 | |
| JP | 3-199491 | | 8/1991 | |
| JP | 04-331182 | * | 11/1992 | |
| JP | 06-183137 | * | 7/1994 | |
| JP | 0725131 | * | 1/1995 | 428/537.5 |
| JP | 0725132 | * | 1/1995 | 428/537.5 |
| JP | 07025131 | * | 1/1995 | |

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is printing paper comprising, as principal components, pulp fibers and a filler, wherein fine particles having a particle diameter within a range of from 5 to 200 nm are held on the pulp fibers exposed on at least one surface of the printing paper in a state that their fibrous form is retained.

19 Claims, 5 Drawing Sheets

PRINTING PAPER, AND INK-JET PRINTING PROCESS USING THE SAME

BACKGROUND OF THE INVENTION

1. Field of the Invention

The present invention relates to printing paper which is suitable for use in color printing using water-based inks, in particular, color printing using an ink-jet system, and has a feeling and handleability as plain paper, and a printing process using such printing paper.

2. Related Background Art

Ink-jet printing systems have attracted attention because of ready attainment of high-speed, full-color and high-density printing. Printing apparatus making good use of an ink-jet printing system have also spread.

Such exclusive coated paper sheets as disclosed in, for example, Japanese Patent Application Laid-Open Nos. 59-35977 and 1-135682 have been used in such ink-jet printing systems.

With the application of the ink-jet printing systems to a wide variety of fields, paper for ink-jet printing is also required to have higher properties. More specifically, it is required to have, for example, the following properties:

(1) having high ink absorbency and hence being able to quickly dry and fix inks;

(2) causing no so-called bleeding in which when ink dots adjoin, the ink dots run out into each other to unevenly mix with each other;

(3) causing no so-called beading in which a coloring material such as a dye aggregates in the form of a bead on the printing paper to cause unevenness of color strength;

(4) causing no diffusion of ink droplets applied to the printing paper so as to prevent the diameter of an ink dot from growing larger;

(5) providing dots high in optical density and causing no blurring at peripheries of characters and. images;

(6) being excellent in-the coloring property development of a coloring material component in an ink;

(7) having good color reproducibility and providing high-definition images; and (8) having excellent water fastness.

Meanwhile, a variety of printing apparatus different in printing system exists in the fields of monochromatic printing and business color printing, and there is demand for development of printing paper easy to obtain, low in price and widely usable in the various printing systems.

Viewing paper for ink-jet printing from the above-described points of view, printing paper for ink-jet printing of the coated paper type permits the formation of a high-definition and bright image. When such paper is intended to use as plain paper, however, it involves, for example, the following problems:

(1) it lacks a feeling and handleability as plain paper (PPC paper, general woodfree paper, etc.);

(2) it is poor in writing quality upon writing with a pencil;

(3) it tends to often generate dust due to falling off of components of a coating layer, i.e., often cause dusting;

(4) it lacks flexibility to other printing systems;

(5) it tends to be expensive compared with plain paper; and (6) it is difficult to form coating layers on both sides of a base paper web, and so printing can be conducted only on one side.

In particular, the occurrence of dusting from the coating layer as described in the problem (3) forms the cause of defective feedability of the printing paper in a printing apparatus. More specifically, a feeding system in a printing apparatus is generally of the type that rubber rollers or the like are brought into contact with the surface of a paper sheet to be fed to feed the sheet by frictional force generated at this time. When dust attaches to the rubber rollers or the like, the desired frictional force can not be obtained, so that the paper sheet tends to undergo defective feedability, which interferes with feeding of the paper sheet into the apparatus, feedability of the paper sheet in the apparatus or discharging of the paper sheet from the apparatus. The problem of such defective feedability particularly markedly arises in the case where a feeding roller comes into contact with the front surface of the paper sheet. Even in the case where the feeding roller comes into contact with the back surface of the paper sheet, however, dust may be often generated due to the contact of the coating layer with parts in the apparatus, such as a guide, and is then suspended in the apparatus to attach to the rubber rollers or the like, thereby causing the same problem as described above.

Meanwhile, printing paper of the plain paper type, which is in commonest use in offices at present, is toner-transfer paper (paper for PPC) for copying machines and the like making use of an electrophotographic system disclosed in Japanese Patent Application Laid-Open Nos. 51-13244, 59-162561 and 59-191068. Among these paper sheets for PPC, there has not been yet found any paper sheet having sufficient ink-jet printability.

The use of the paper for PPC, which is in common use at present, in ink-jet printing may involve, for example, the following disadvantages in many cases.

(1) Absorbency of water-based ink is poor, so that when a great amount of an ink is applied to the paper, the drying and fixing of the ink are delayed (if an object comes into contact with the printed surface in the state that the ink is neither fixed nor dried, the image formed is impaired).

(2) A water-based ink feathers along fibers making up the paper at the time the ink is absorbed in a paper layer, so that the so-called feathering, in which ink dots grow too large, and/or the peripheries of the ink dots become jagged and blurred, occurs, resulting in a failure of the provision of clear characters and images.

(3) In printing of color images, the so-called bleeding, in which when ink dots of different colors are printed adjoiningly to each other, the ink dots run out into each other to cause undesired color mixing, occurs, so that the clearness and coloring of the image formed are impaired, resulting in a failure of the provision of satisfactory images in many cases. For example, when bleeding occurs at boundaries between solid printed areas of different colors, clarity of the boundaries may be impaired, the colors may bleed, or uneven color mixing may be observed.

(4) The water fastness of the image formed is insufficient because the paper for PPC has no special construction for fixing water-soluble coloring materials such as dyes.

(5) The coloring material such as a dye used in an ink penetrates into the interior of the paper together with a solvent for the ink, so that the coloring property of the coloring matter becomes insufficient.

SUMMARY OF THE INVENTION

It is an object of the present invention to provide printing paper having a feeling and handleability as plain paper while retaining excellent printability of special exclusive paper for ink-jet for water-based inks.

Another object of the present invention is to provide printing paper both sides of which can be used as printing surfaces, and which is also suitable for use in ink-jet printing.

A further object of the present invention is to provide printing paper suitable for use in ink-jet printing and hard to cause a feeding trouble even in a printing apparatus using any of feeding systems.

A still further object of the present invention is to provide an ink-jet printing process using these printing paper sheets.

Such objects can be achieved by the present invention described below.

According to the present invention, there is thus provided printing paper comprising, as principal components, pulp fibers and a filler, wherein fine particles having a particle diameter within a range of from 5 to 200 nm are held on the pulp fibers exposed on at least one surface of the printing paper in a state that their fibrous form is retained.

According to the present invention, there is also provided an ink-jet printing process comprising the step of applying droplets of an ink to the printing paper described above to conduct printing.

According to the present invention, there is further provided a printing system comprising an ink-jet printing apparatus and printing paper used therein, wherein the printing paper is the printing paper described above.

According to the present invention, there is still further provided an ink-jet printing process comprising using an ink-jet printing apparatus comprising a feeding means adapted to come into contact with one surface of a printing paper sheet among a stack of printing paper sheets to feed the printing paper sheet to a printing position, and a means for separating the printing paper sheet from the stack of printing paper sheets to conduct printing on the printing paper described above.

DESCRIPTION OF THE PREFERRED EMBODIMENTS

The printing paper according to the present invention features that fine particles having a particle diameter within a range of from 5 to 200 nm are held on the surfaces of the pulp fibers exposed on at least one surface of the paper in a state that their fibrous form is retained. However, it is preferred that all the pulp fibers exposed on the printing surfaces of the printing paper be covered with the fine particles.

As described above, the printing paper according to the present invention is characterized by the unique structure of a surface used in printing (a printing surface). For example, in a conventional coated paper sheet for ink-jet, the coating layer of which is thick, its pulp fibers are completely coated with the coating layer, and so its fibrous form does not appear on the surface. Besides, in another conventional coated paper sheet the fibers of which are exposed on the surface thereof, it is so constructed that particles in the form of rubble having a particle diameter of from about 2 to 30 $\mu$m and the fibers exist by mixture. Therefore, it is quite different from those like the printing paper sheet according to the present invention, in which fine particles having a particle diameter within a range of from 5 to 200 nm are held on the pulp fibers exposed on the printing surface thereof. Further, the pulp fibers exposed on the surface of the plain paper do not hold any fine particles. This surface structure also differs from the surface characteristic of the printing paper according to the present invention.

Figure 1:
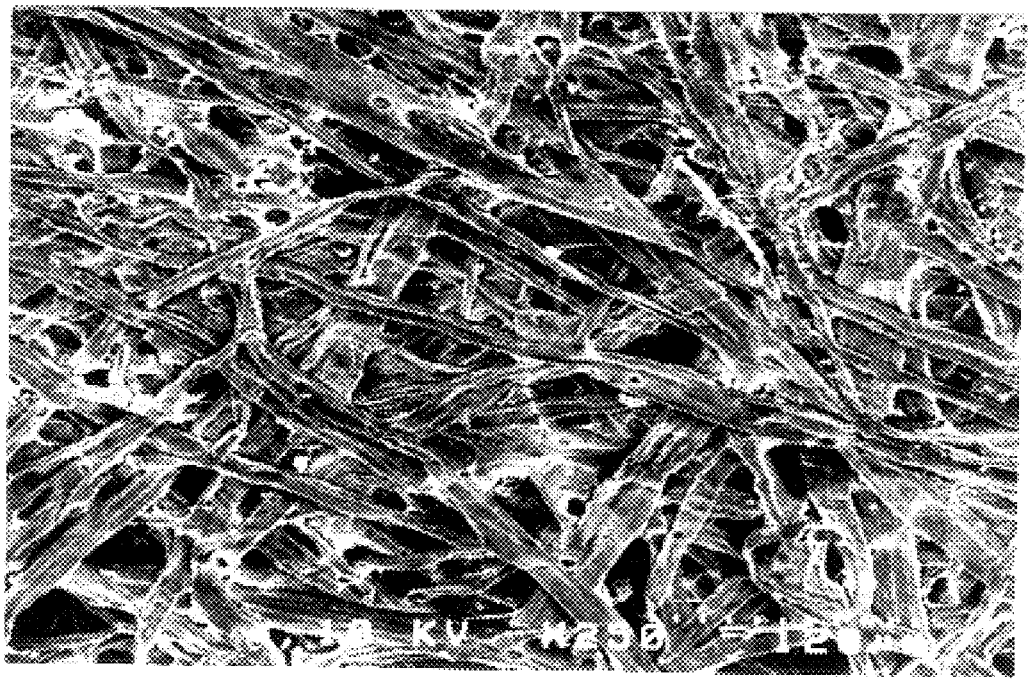
FIG. 1 is a 250-times enlarged photograph illustrating the form of fibers on the surface of printing paper according to the present invention
Figure 2:
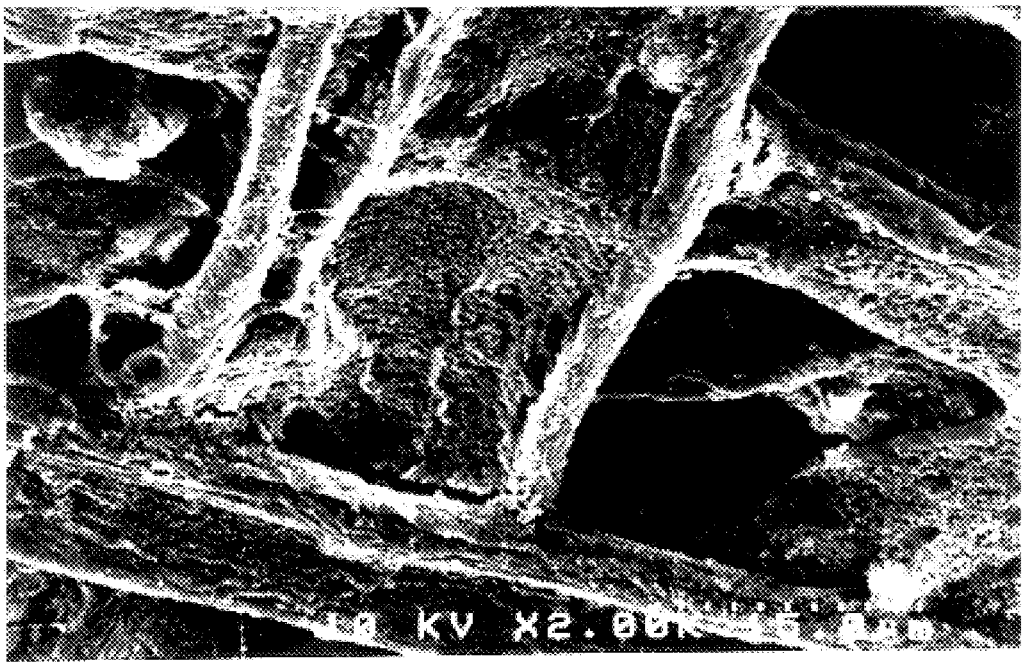
FIG. 2 is a 2,000-times enlarged photograph illustrating the form of fibers on the surface of printing paper according to the present invention and the particle structure of fine particles attached thereto.

A typical surface structure of the printing surface of printing paper according to a preferred embodiment of the present invention is illustrated in FIGS. 1 and 2. As apparent from FIG. 1, which is a photograph enlarged 250 times, the form of the pulp fibers clearly appears in the form of irregularities on the printing surface thereof. According to FIG. 2, which is a photograph more enlarged (2,000 times) than the photograph of FIG. 1, the individual fibers are covered with the fine particles. However, the fibrous form of the individual fibers is retained as apparent from FIG. 1. As described above, the printing paper according to the present invention is constructed by fixing the fine particles to the surfaces of the pulp fibers exposed on the printing surface thereof. The present invention is characterized in that the form of the fibers is not impaired by this anchoring of the fine particles. The surface structure of the printing paper according to the present invention is clearly distinguished from the conventional coated paper and plain paper.

In the printing paper according to the present invention, there may be some portions at which the pulp fibers situated at the printing surface thereof do not retain their fibrous form. A proportion of the portions (including portions on which the fine particles are and are not held), at which the pulp fibers retain their fibrous form on the printing surface to the printing surface, should be preferably at least 70%, more preferably at least 90%. In the case where the fine particles form a coating layer, percent coverage of the fine particles may be at least 50%, preferably at least 70% of the whole pulp fibers situated at the printing surface. Namely, it is preferable that the whole surface of the pulp fibers be covered with a coating layer composed principally of the fine particles. However, the pulp fibers may be partially covered within limits successfully attaining the objects of the present invention. The percent coverage of the fine particles can be visually determined by such a scanning electron microphotograph as illustrated in FIG. 1.

According to the function-separating type construction of the printing paper of the present invention, a coloring material such as a dye in an ink applied to its printing surface is mainly captured by the fine particles held on the surfaces of the fibers, while a solvent component in the ink is mainly absorbed in the interior of a paper layer thereof. To the contrary, in the conventional coated paper for ink-jet, the particles in the form of rubble situated at the surface thereof combine the function of capturing the coloring material with the function of absorbing the solvent component, whereby printability such as excellent ink absorbency and coloring can be exhibited. In the case of this coated paper, however, there may be caused, in some cases, such problems that the coating layer and particles in the form of rubble cause parts making up a feeding system in a printing apparatus, for example, rubber rollers and/or the like, to be worn, and that a component (called "dust" and composed mainly of a pigment) separated from the coating layer attaches to the rubber rollers, which forms the cause that defective feedability is incurred. In the case of the plain paper, such problems are lessened, but both coloring material and solvent component in the ink penetrate into the interior of the paper along the pulp fibers of the paper because a special capturing part for the coloring material is not provided thereon, so that fully satisfactory properties are difficult to achieve as to the ink absorbency and-optical density as described above.

The printing paper according to the present invention can be obtained by causing fine particles having a particle diameter within a range of from 5 to 200 nm to be held on the surfaces of pulp fibers exposed on portions serving as printing surface(s) of one side, preferably both sides of a base paper web composed principally of the pulp fibers and a filler.

The base paper web can be made by subjecting a paper stock composed principally of pulp fibers and a filler to a paper making process in accordance with the method known per se in the art. As the pulp fibers, any fibrous pulp may be used without any particular limitation so far as it is used in the usual paper making. For example, however, chemical pulp typified by LBKP and NBKP, mechanical pulp, regenerated pulp from waste paper, nonwoody pulp or a mixture of two or more of these materials may be used.

In the manufacture of the base paper web, for example, the conventional paper making process, in which fibrous pulp and a filler as main components, and other optional components such as a sizing agent and auxiliaries for paper making are employed to make paper, may be used.

Examples of the filler include calcium carbonate, kaolin, talc and titanium dioxide, with kaolin being particularly preferred. Since inks for ink-jet printing generally contain a nitrogen compound such as ammonia (ammonium ion) or urea for improving the solution stability of a coloring material, in a printing medium which captures the coloring material at its surface, a problem of bronzing caused by the fact that the coloring material aggregates on the surface thereof may arise in some cases due to the inclusion of the nitrogen compound. However, the use of kaolin as a filler has an advantage that this bronzing phenomenon becomes hard to occur. Incidentally, the bronzing phenomenon is a phenomenon that the hue of a black printed area looks reddish.

Examples of the sizeing agent include rosin sizes, alkylketene dimers, alkenylsuccinic anhydrides, petroleum resin sizes, epichlorohydrin, acrylamide and the like.

As the fine particles to be held on the surfaces of the pulp fibers, inorganic fine particles and organic fine particles may be used without any limitation so far as they are fine particles having a particle diameter within a range of from 5 to 200 nm and have the function of capturing a coloring material in an ink. Preferable examples thereof include fine particles of silica, synthetic silicates, alumina, alumina hydrate, titanium oxide, cerium oxide, zinc oxide and the like. These may be used either singly or in any combination thereof. If the particle diameter is smaller than the lower limit of the above range, the ink absorbency of the resulting printing paper is lowered, and the printing paper tends to cause problems such as occurrence of beading. If the particle diameter is greater than the upper limit of the above range on the other hand, the specific surface area of portions of the surfaces of the fibers, on which the fine particles are held, is reduced, so that the capacity of the resulting printing paper for capturing a coloring material component in an ink to be applied is reduced, and the printing paper tends to cause a problem that the reduction in optical density of an image to be formed is incurred.

The fine particles to be held on the surfaces of the fibers are preferably held in the state of primary particles on the surfaces of the fibers. Some aggregate of the primary particles and aggregate of the conventionally-known secondary particles may attach to the surfaces of the fibers. However, the fine particles to be held are preferably composed principally of primary particles.

Incidentally, a diameter of particle held actually on a surface of fibers can be obtained as an averaged value of diameters of several tens to hundreds particles, which are measured directly from an enlarged photo such as an SEM photo and the like. In a case that a particle is not in a spherical form, an averaged value of the longest diameter and the shortest diameter of the particle shall be the particle diameter.

The amount of the fine particles to be held in the printing paper is preferably adjusted in such a manner that it falls within a range of, for example, from 0.1 to 6 $g/m^2$. In the case where the fine particles are caused to be held on one side of the base paper, the amount of the fine particles is preferably adjusted within a range of from 0.05 to 3 $g/m^2$.

The holding of the fine particles on the surfaces of the fibers can be achieved by mixing a resin having a function as a binder component for binding the fine particles together with the fine particles in a suitable solvent to prepare a coating formulation, applying this coating formulation to the intended portion of a base paper web and drying the coating formulation.

As the binder resin, there may be used casein, starch, cellulose derivatives such as carboxymethylcellulose and hydroxyethylcellulose, hydrophilic resins swelling in inks, such as polyvinyl alcohol, polyvinyl pyrrolidone, sodium polyacrylate and polyacrylamide, SBR latices, acrylic emulsions, resins having a hydrophilic moiety and a hydrophobic moiety in their molecules, such as styrene/acrylic acid copolymers, those mentioned above as the sizes, and the like. These resins may be used either singly or in any combination thereof.

The amount of the coating formulation to be applied is preferably such that the fine particles are held in the printing paper within the above-described range. A preferable mixing ratio by weight of the fine particle to the binder resin is within a range of from 10/1 to 1/5, more preferably from 5/1 to 1/2. If the proportion of the fine particles is higher than the upper limit of the above range, dusting of the fine particles may occur in some cases even if the surface profile of the resulting printing paper becomes a surface profile defined in the present invention. If the proportion of the binder resin is higher than the upper limit of the above range on the other hand, the ink absorbency of the resulting printing paper tends to be lowered, and the printing paper tends to cause bleeding.

As a process for applying the coating formulation to the base paper web, there may be used a process of directly applying it, a process of once applying it to another base material and then transfer it to the base paper web, a process of spraying the base paper web with the coating formulation by a sprayer or the like, etc. Examples of the direct coating process include roll coater, blade coater, air knife coater, gate roll coater, size pressing and Symsizer processes.

The drying of the coating formulation can be conducted by using, for example, a hot-air drying oven or heating drum. The resulting printing paper may be further subjected to supercalendering so as to smooth the surface or improve the strength of the surface.

In the respective steps of the preparation of the coating formulation, the application of the coating formulation to the base paper web and the drying of the base paper web, to which the coating formulation has been applied, in the production of the printing paper according to the present invention, it is preferable to suitably select conditions under which the secondary aggregation of the fine particles does not occur. In the application of the coating formulation to the base paper web, it is preferable to use conditions under which the coating formulation does not penetrate into the interior of the paper so as to effectively apply the fine particles to the pulp fiber exposed on the surface of the base paper web.

The water extraction pH of the printing paper according to the present invention may be suitably selected according to the shelf stability thereof and the like. For example, when the printing paper is required to have good long-term shelf stability, it is desirable that the printing paper be adjusted to a water extraction pH of 6 or higher, preferably 7 or higher. If the water extraction pH is lower than 6, a disadvantage that sufficient coloring on the printing paper can not be attained according to a coloring material used in an ink may be incurred in some cases. The upper limit of the water extraction pH is desirably preset to 10 or lower, preferably 9 or lower. If the water extraction pH exceeds this upper limit (pH 10), a disadvantage that the coloring of the coloring material is not sufficiently exhibited on the paper may be incurred in some cases. The water extraction pH is a value obtained by measuring the pH of an extract obtained by immersing 1.0 g of a test piece prescribed in JIS P 8133 in 70 ml of distilled water in accordance with JIS Z 8802.

No particular limitation is imposed on the Stöckigt sizing degree of the printing paper according to the present invention, and it may be suitably selected within a range in which good ink-fixing ability and drying ability can be attained. However, the Stöckigt sizing degree is preferably adjusted within a range of from 10 to 40 seconds. If the Stöckigt sizing degree is higher than the upper limit of the above range, the ink absorbency of the resulting printing paper, in particular, the penetration and absorption of a solvent component in an ink into the paper may become insufficient in some cases. On the other hand, if the Stöckigt sizing degree is lower than the lower limit of the above range, feathering, dot gain and the like may occur on an image formed on such a paper in some cases when an ink having a surface tension within a-range as low as 25 to 40 dyn/cm is used, so that the quality of the image may become insufficient. The upper limit of the basis weight of the printing paper according to the present invention is preferably about 200 g/m$^2$ in the case where its feedability is taken into consideration. The lower limit thereof is, for example, 50 g/m$^2$. If the basis weight is less than 50 g/m$^2$, strike-through and cockling may occur on the resulting print paper in some cases.

The printing paper according to the present invention is comparable to the conventional neutralized paper for PPC in the feeling and handleability (surface configuration, physical properties, etc.) as plain paper. Further, when it is used in printing with water-based inks using an anionic dye as a coloring material like general ink-jet inks, it can more effectively prevent the occurrence of bleeding and provide a very bright image with good optical density. According to this printing paper, a problem of defective feedability in a printing apparatus due to dusting can also be solved.

The following three embodiments may be mentioned as the preferred embodiments of the present invention.

1) The printing paper is prepared in such a manner that it has the unique surface configuration described above, and moreover when conducting a Bristow test with an ink having a surface tension within a range of from 25 to 35 dyn/cm, it has two absorption coefficients Ka1 and Ka2 (Ka1<Ka2) and preferably satisfies the following conditions:

| | |
|---|---|
| $2.0 \leqq Th$ | [msec$^{1/2}$] |
| $2.0 \leqq tw \leqq 4.5$ | [msec$^{1/2}$] |
| $5.0 \leqq Kr$ | [ml/m$^2$] |
| $Ka \leqq 5.0$ | [ml/(m$^2$ · msec$^{1/2}$] |

wherein Th is contact time required for the absorption coefficient to change from Ka1 to Ka2 when measured with an ink having a surface tension within a range of from 25 to 35 dyn/cm, and tw, Kr and Ka are wetting time, a roughness index and a absorption coefficient, respectively, when measured with an ink having a surface tension within a range of from 45 to 60 dyn/cm.

According to such printing paper, the print quality of a black color can be made better, and good printing is feasible even in a printing system using a black ink having a high surface tension and color inks each having a low surface tension for the purpose of lessening the occurrence of bleeding at a boundary between an area printed with the black color and an area printed with the color ink.

The Bristow test is a testing method prescribed in The Japanese Technical Association of the Pulp and Paper Industry (J'TAPPI) and described in detail in J'TAPPI No. 51, Testing Method for Liquid Absorptivity of Paper and Paperboard. Upon the measurement, a slit width of a head box of a Bristow tester is adjusted according to the surface tension of an ink used. When an ink used passes through the back side of paper tested, a calculation is made taking this point into no consideration.

The present inventors have found that the ink-jet printability has correlation with the results of the Bristow test for paper, thus leading to the completion of the present invention.

Figure 3:
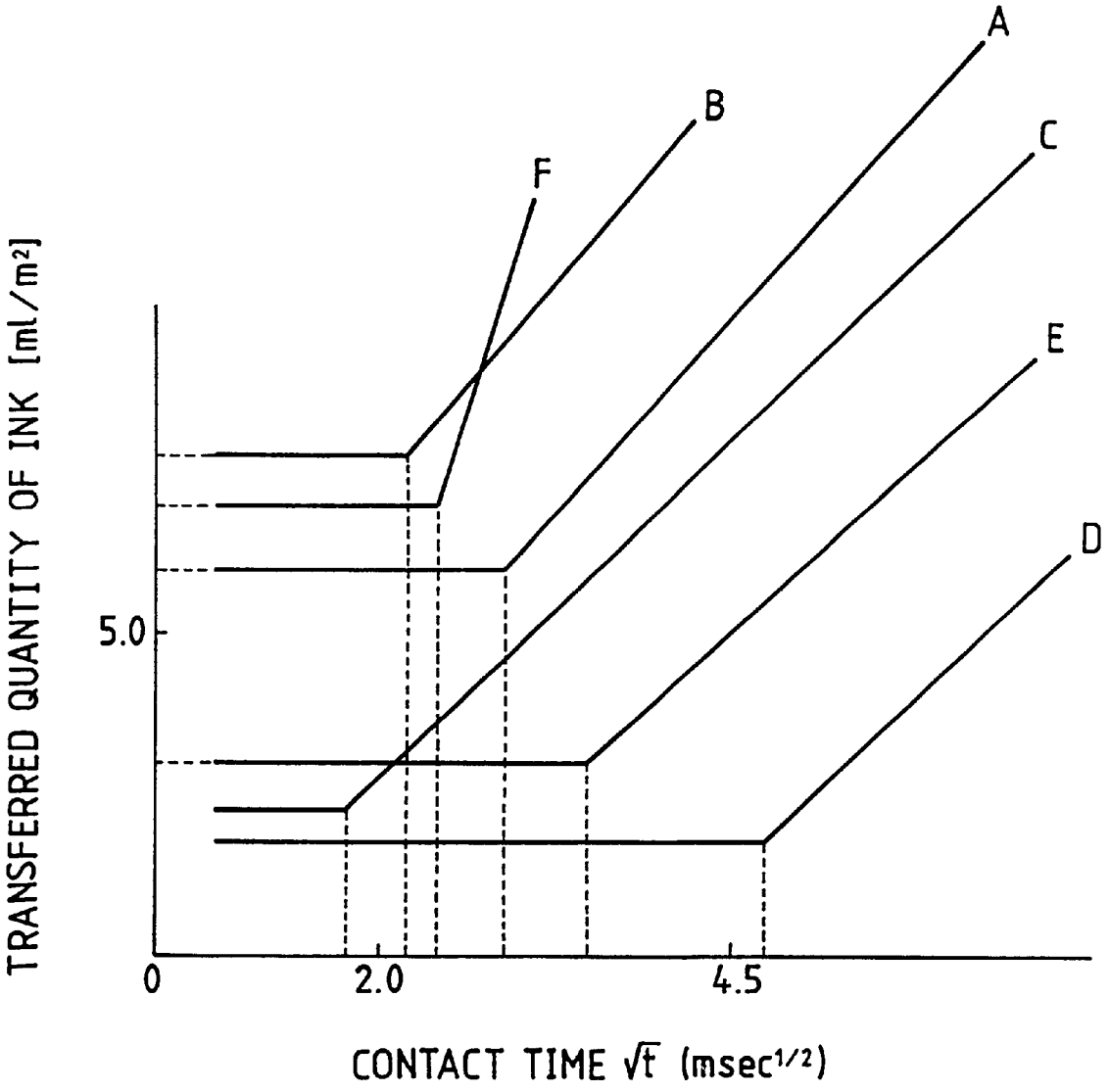
FIG. 3 diagrammatically illustrates a relationship between the contact time with ink and the transferred quantity of ink in printing paper sheets.

Measurement results of the Bristow test for Printing Paper A to F are illustrated in FIG. 3. The graph shows the results obtained by conducting the measurement with the ink having a surface tension of from 45 to 60 dyn/cm. Incidentally, Th has been measured using an ink having a surface tension of from 25 to 35 dyn/cm. In the Bristow test, a transferred quantity of a liquid per unit area (v: ml/m$^2$) versus the one half power [$t^{1/2}$ (msec$^{1/2}$)] of the contact time of the liquid with paper is found. The wetting time (tw) and the roughness index (Kr) are respectively considered to be the time when the transferred quantity becomes constant, and the average depth of hollows in the paper. The absorption coefficient (Ka) is expressed by a slope of the graph. The tw, Kr and Ka values of Printing Paper A to F are as follows.

| Printing Paper | (Th) | tw | Kr | Ka |
|---|---|---|---|---|
| A | (≧2.0) | 2.0 ≦ tw ≦ 4.5 | 5.0≦ | ≦5.0 |
| B | (<2.0) | 2.0 ≦ tw ≦ 4.5 | 5.0≦ | ≦5.0 |
| C | (≧2.0) | 2.0 > tw | 5.0≦ | ≦5.0 |
| D | (≧2.0) | tw > 4.5 | 5.0≦ | ≦5.0 |
| E | (≧2.0) | 2.0 ≦ tw ≦ 4.5 | 5.0≧ | ≦5.0 |
| F | (≧2.0) | 2.0 ≦ tw ≦ 4.5 | 5.0≦ | >5.0. |

Printing Paper A has the following values: 2.0≦Th, 2.0≦tw≦4.5, 5.0≦Kr and Ka≦5.0, and hence satisfies all the above conditions. Therefore, this printing paper can provide a high-definition image high in optical density, free of bleeding, distinct and sharp in edge as characters and good in water fastness even when it is used in a printing system using inks of various surface tensions. In particular, the use of the printing paper according to the present invention in a printing system using an ink having a high surface tension as a black ink and inks each having a low surface tension as color inks can achieve a better effect.

Printing Paper B has the following values: 2≦tw≦4.5, 5.0≦Kr and Ka≦5.0, and hence can provide an image high in optical density, free of bleeding and good in water fastness. Since the paper is 2>Th, however, the paper is too good in ink absorbency, in particular, in a printing system using inks each having a low surface tension, so that the optical density of an image formed on such paper becomes low, and it tends to provide an image low in character quality.

Printing paper C is 2.0≦Th and hence can provide an image good in optical density. Since the paper is tw≦2.0, however, its wetting time is short, in particular, in an ink having a high surface tension, so that the ink becomes easy to feather along fibers of the paper, and the edges of characters printed tend to become jagged and blurred. Therefore, the image formed on such paper tends to lower character quality.

Printing paper D is 2.0≦Th and hence can provide an image good in optical density. Since the paper is 4.5≦tw, however, its wetting time is too long, so that it tends to cause bleeding, in particular, in a printing system using inks each having a high surface tension, and the inks are hard to be completely absorbed in the printing paper and hence dried thereon. Therefore, the image formed on such paper tends to lower water fastness.

Printing paper E is 2.0≦Th and hence can provide an image good in optical density. Since the paper is Kr≦5.0, however, the surface area of the paper is small, a coloring material in an ink when using an ink having a high surface tension becomes hard to be bonded to a water-proofing agent in the ink, so that the image formed on such paper tends to lower water fastness.

Printing paper F is 2.0≦Th and hence can provide an image good in optical density. Since the paper is 5.0≦Ka, however, the penetrability of an ink when using an ink having a high surface tension becomes too high, so that the ink becomes easy to feather along fibers of the paper, and the edges of characters printed tend to become jagged and blurred. Therefore, the image formed on such paper tends to lower character quality.

So far as the printing paper satisfies the above conditions, it can provide an image high in optical density and good in character quality and water fastness even in a printing system using inks of various surface tensions.

The printing paper according to the first embodiment is suitable for use in a system using inks each having a high surface tension and inks each having a low surface tension in combination. When printing is conducted on the printing paper according to the present invention using an ink having a high surface tension (45 to 60 dyn/cm) as a black ink and inks each having a low surface tension (25 to 40 dyn/cm) as yellow, magenta and-cyan inks, a high-definition image high in optical density, good in quality of black characters and water fastness and free of bleeding.

2) The printing paper is prepared in such a manner that it has the unique surface configuration described above, and moreover the retention of frictional force of its printing surface is at least 80%.

According to such printing paper, trouble of a feeding system scarcely occurs even when it is continuously used in a printing apparatus using the conventional feeding system.

The retention of frictional force as used herein refers to a value measured by the following method.

Namely, the retention of frictional force is a ratio (F2/F1), in terms of percentage, of frictional force (F2) between a rubber material in the form of a flat plate and the surface of printing paper after rubbing the surface of the sheet with the rubber material by the predetermined number of times under a fixed load to frictional force (F1) between the rubber material and the surface of the printing paper before the rubbing.

The measurement is conducted by using, as the rubber material, EPDM (ethylene-propylene-diene rubber.) molded in the-form of a substantial square having a thickness of 1 to 10 mm and an area of 5 to 10 $cm^2$ in an environment of 18 to 28° C. and 40 to 65% RH. The frictional force (F1) is static frictional force between the rubber material and the surface of the printing paper as measured under a load of about 40 $g/cm^2$. The rubbing between the rubber material and the surface of the printing paper is conducted by horizontally moving the rubber material by a distance of 25 cm on the surface of the printing paper placed on a horizontal plane at a rate of about 2 to 5 cm/sec under a load of 40 $g/cm^2$ and repeating this operation 10 times. The frictional force (F2) is static frictional force between the rubber material rubbed and the printing surface of the printing paper not rubbed as measured in the same manner as in the measurement of F1.

The retention of frictional force of the surface of the printing paper can be adjusted by applying the fine particles to both surfaces of the base paper and adjusting the particle diameter and amount of the fine particles to be applied to the surfaces, the mixing ratio of the fine particles to the binder to be applied to the surfaces, the degree of penetration of the binder into the base paper, the sizing degree of the paper (base paper), etc. among the specific preparation means described above. The particle diameter and amount of the fine particles to be applied, the mixing ratio of the fine particles to the binder and the degree of penetration of the binder are particularly important.

The mixing ratio by weight of the fine particles to the binder resin is preferably within a range of from 10/1 to 1/2, more preferably from 4/1 to 1/1. The use of the resin in a too great amount is effective for the adjustment of the retention of frictional force, but the resulting printing paper is lowered in ink absorbency, and so the brightness of an image-formed thereon is lowered. On the other hand, the use of the resin in a too small amount makes it difficult to adjust the retention of frictional force.

3) The printing paper is prepared in such a manner that it has the unique surface configuration described above, and moreover a degree of show-through measured with a liquid having a surface tension of 30±2 dyn/cm falls within a range of from 0.05 to 0.25, preferably from 0.05 to 0.20. The surface tension as used herein is a value measured in an environment of 23±2° C.

The degree of show-through (S) as used herein is a value obtained by preparing a testing liquid comprising water, an organic solvent, a surfactant and other additive components and having a specific surface tension in an environment of 18 to 28° C. and 45 to 65% RH, applying the testing liquid to the printing surface of printing paper to be tested by an ink-jet printing head or the like in a density of 27±2 nl/mm$^2$, measuring an optical density (OD1) of a portion of the back side corresponding to the liquid-applied area of the printing surface and an optical density (OD2) of a portion of the back side corresponding to the liquid-unapplied area of the printing surface by means of a Macbeth densitometer or the like upon elapsed time of 24 hours after the application, and calculating in accordance with the following equation $$S=(OD1)-(OD2).$$

An illustrative composition of the above testing liquid is mentioned below. (Illustrative composition of testing liquid)

| | |
|---|---|
| Surface tension: 31 dyn/cm | |
| Diethylene glycol | 10 parts |
| Glycerol | 5 parts |
| Urea | 7.5 parts |
| Acetylene glycol | 1 part |
| Dye (described below) | 4 parts |
| Water | 72.5 parts. |

As the dye, one of dyes, which will be described subsequently, or a combination thereof is used.

As the composition of the testing liquid, any liquid may be used so far as its surface tension falls within the above range. However, the concentration of the dye in the testing liquid must be within a range of from 4 to 4.5% by weight. Besides, a liquid having a viscosity within a range of 2±0.2 cP as measured in an environment of 25° C. is used.

The degree of show-through in the printing paper according to the present invention serves as an index indicative of the distribution state of coloring materials in the interior of a paper layer in a plain paper type paper sheet when conducting full-color printing. When printing paper is prepared using, as an index, the degree of show-through according to the above method, there can be provided printing paper which can provide high-quality images high in optical density and free of bleeding on both sides thereof.

The degree of show-though of the paper can be adjusted by applying the fine particles to both surfaces of the base paper and adjusting the particle diameter and amount of the fine particles to be applied to the surfaces, the basis weight of the base paper, the opacity of the base paper, etc. among the specific preparation means described above, and besides the amount and degree of penetration into the base paper of a cationic substance to be applied to the surfaces if the cationic substance is newly applied thereon. The particle diameter and amount of the fine particles to be applied, the use of the cationic substance, and the amount and degree of penetration into the base paper of the cationic substance are particularly important.

As the cationic substance, any of cationic low-molecular weight substances and cationic high-molecular weight substances, the examples of which will be mentioned subsequently, may be used. The printing paper according to this embodiment of the present invention can be obtained by containing at least one cationic substance. In particular, when a cationic substance having a molecular weight of 1,000 or lower and a cationic high-molecular weight substance having a molecular weight of 2,000 or higher are used in combination, the water fastness, coloring and quality of an image printed on the resulting printing paper can be improved.

Specific examples of the cationic low-molecular weight substances preferably having a molecular weight of from 100 to 710 are mentioned below. Namely, they includes compounds of the primary, secondary and tertiary amine salt types, such as the hydrochlorides and acetates of laurylamine, coconut amine, stearylamine, rosin amine and the like; compounds of the quaternary ammonium salt type, such as lauryltrimethylammonium chloride, lauryldimethylbenzylammonium chloride, benzyltributylammonium chloride and benzalkonium chloride; pyridinium salt type compounds such as cetylpyridinium chloride and cetylpyridinium bromide; imidazoline type cationic compounds such as 2-heptadecenylhydroxyethylimidazoline; and ethylene oxide adducts of higher alkylamines such as dihydroxyethylstearylamine. Metal compounds may also be used. Specific examples thereof include aluminum lactate, basic aluminum polyhydroxide, aluminum chloride, sodium aluminate and aluminum acrylate.

Examples of the cationic high-molecular weight substances having a molecular weight of 2,000 or higher, preferably from 10,000 to 1,000,000 include polyallylamine and the hydrochloride thereof, polyamine sulfone and the hydrochloride thereof, polyvinylamine and the hydrochloride thereof, and chitosan and the acetate thereof. It goes without saying that the cationic high-molecular weight substances are not limited to these substances. The salts of these polymers are also not limited to the hydrochlorides and acetates. Nonionic high-molecular weight substances may be partially cationized for use. Specific examples thereof include copolymers of vinylpyrrolidone with a quaternary ammonium salt of an aminoalkyl acrylate and copolymers of acrylamide with a quaternary ammonium salt of aminomethylacrylamide. However, it goes without saying that the partially cationized high-molecular weight substances are not limited to these polymers. It is most satisfactory that the above-mentioned cationic high-molecular weight substances be water-soluble. However, they may be provided in the form of a dispersion such as a latex or emulsion.

If used in combination, a preferable mixing ratio by weight of the cationic low-molecular weight substance to the cationic high-molecular weight substance is within a range of from 20/1 to 1/20, more preferably from 1/1 to 1/9. When they are used within the above range, the resulting printing paper has an effect that it can provide an image excellent in water fastness and besides superb in image quality and optical density. These cationic substances are applied to the printing paper in a proportion of from 0.1 to 6 g/m$^2$, preferably from 1 to 4 g/m$^2$.

As described above, the degree of show-through is also affected by the basis weight and opacity of the paper. In the printing paper according to the third embodiment of the present invention, the basis weight is preferably adjusted within a range of from 50 to 100 g/m$^2$, more preferably from 70 to 90 g/m$^2$, while the opacity is adjusted within a range of from 80 to 95%.

If the degree of show-through is lower than the lower limit of the above range, the penetration of a solvent in an ink into the interior of the printing paper becomes slow, and the ink becomes easy to run out along the printing surface, so that bleeding becomes easy to occur. If the degree of show-through is higher than the upper limit of the above range on the other hand, a coloring matter in an ink becomes easy to deeply penetrate into the interior of the printing paper or in an extreme case, up to the back side of the paper, and so the optical density of the image formed tends to lower. Besides, such too high degree of show-through may interfere with printing on both sides in some cases.

The formation of an image by an ink-jet system on the printing paper according to the present invention, which is constructed in the above-described manner, can be conducted in the following manner.

As inks used in the formation of the image, any inks may be used without any limitation so far as they are inks applicable to the ink-jet system. For example, those comprising, as essential components, a coloring material for forming an image and a solvent component dissolving or dispersing the coloring material therein may be used.

Example of the coloring materials used in the inks include direct dyes, acid dyes, basic dyes, reactive dyes, food colors, disperse dyes, oil colors and various pigments. For example, the conventionally-known dyes may be used without any limitation. When water-soluble dyes having an anionic group are used like general inks for ink-jet, water-soluble acid dyes, direct dyes or reactive dyes, which are described in COLOR INDEX and each have an anionic group, can be used. Any dyes not described in COLOR INDEX may also be used without any particular limitation so far as they have an anionic group, for example, a sulfonic group or a carboxylic group. Among the water-soluble dyes used herein, those having dependence of solubility on pH may also be included.

The content of the coloring material in an ink is determined on the basis of properties required of the ink, and the like. However, the coloring material may be used in a general concentration of from about 0.1 to 20% by weight.

As the solvent component for the ink, for example, water or a mixture of water and a water-soluble organic solvent may preferably be used. Specific examples of the water-soluble organic solvent include amides such as dimethylformamide and dimethylacetoamide; ketones such as acetone; ethers such as tetrahydrofuran and dioxane; polyalkylene glycols such as polyethylene glycol and polypropylene glycol; alkylene glycols such as ethylene glycol, propylene glycol, butylene glycol, triethylene glycol, thiodiglycol, hexylene glycol and diethylene glycol; 1,2,6-hexanetriol; lower alkyl ethers of polyhydric alcohols, such as ethylene glycol methyl ether, diethylene glycol monomethyl ether and triethylene glycol monomethyl ether; monohydric alcohols such as ethanol, isopropyl alcohol, n-butyl alcohol and isobutyl alcohol; glycerol; N-methyl-2-pyrrolidone; 1,3-dimethyl-2-imidazolidinone; triethanolamine; sulfolane; dimethyl sulfoxide and the like. These solvents may be used either singly or in any combination thereof. No particular limitation is imposed on the content of the water-soluble organic solvents in the ink. However, it may preferably be within a range of from 1 to 50% by weight, more preferably from 2 to 30% by weight based on the total weight of the ink.

In the inks used in the present invention, there may be incorporated various additives such as viscosity modifiers, pH adjustors, antiseptics (mildewproofing agents), surfactants, antioxidants and evaporation-facilitating agents as needed. When the surfactants are used, it is particularly important to select them from the viewpoint of adjusting the penetrability of the inks into the printing paper.

In the printing on the printing paper according to the present invention, inks having a surface tension within a range of from 25 to 60 dyn/cm may preferably be used. In order to still more exhibit the properties of the printing paper, however, it is preferable that the surface tension of each of color inks such as yellow, cyan and magenta inks be within a range of from 25 to 40 dyn/cm, and the surface tension of a black ink be within a range of from 45 to 60 dyn/cm. The use of the inks respectively having the surface tensions within the above ranges can improve the drying ability of the inks and prevent the occurrence of bleeding at boundaries between areas printed with the black ink and the color inks.

As an ink-jet printing system usable in ink-jet printing on the printing paper according to the present invention, there may be any of ink-jet printing systems in which minute droplets of a water-based ink are ejected from a flow path (orifice) of the ink by means of any one of various working principles to conduct printing. As a typical example thereof, may be mentioned a system described in Japanese Patent Application Laid-Open No. 54-59936, in which an ink undergoes a rapid volumetric change by an action of thermal energy applied to the ink in a flow path of the ink, so that the ink is ejected out of an ejection orifice situated on the tip of the ink flow path by the working force generated by this change of state.

Figure 4:
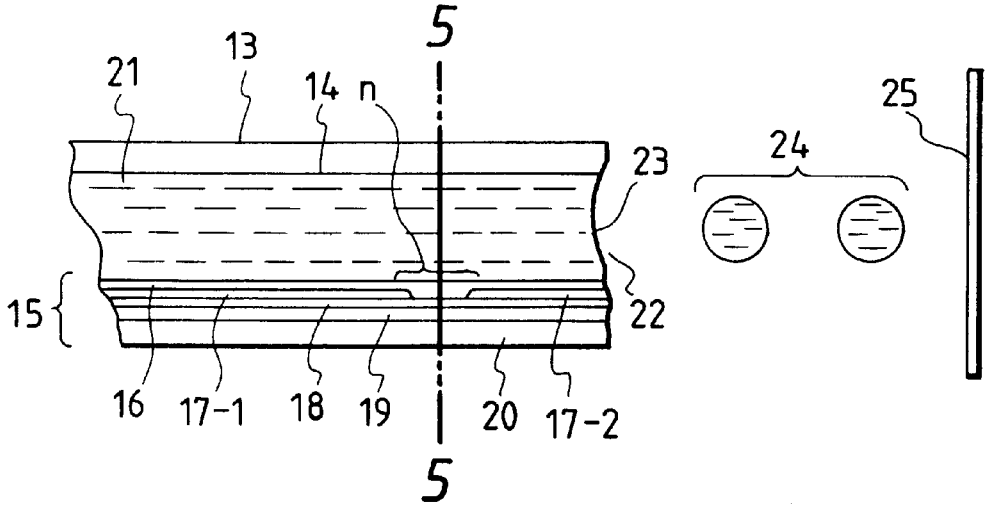
FIG. 4 is a longitudinal cross section, taken along the flow path of ink, of a head of an ink-jet printing apparatus which may be used in a process according to the present invention.
Figure 5:
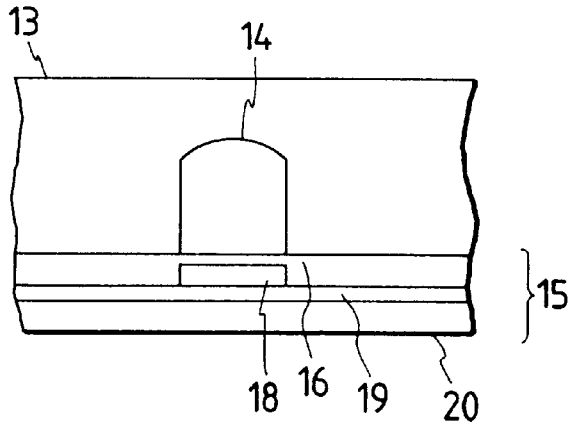
FIG. 5 is a transverse cross section, taken along line 5—5, of the head shown in FIG. 4.
Figure 6:
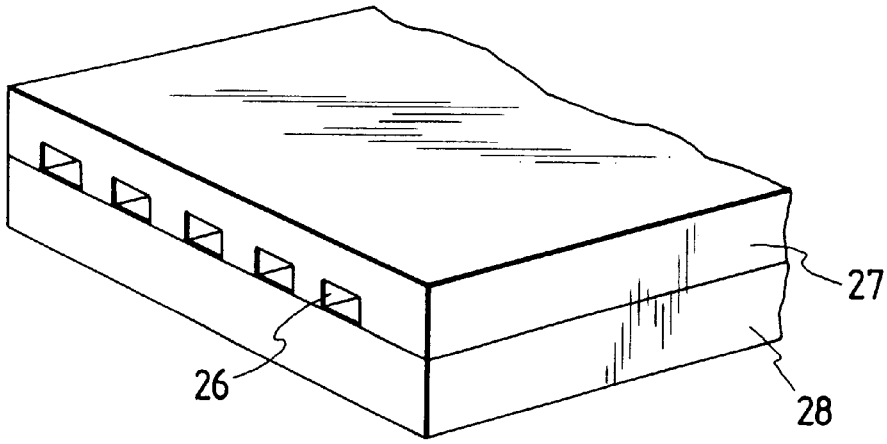
FIG. 6 is a perspective view of the appearance of a multi-head in which a plurality of ink flow paths is arranged side by side.

An illustrative example of an ink-jet printing apparatus, which may be employed in the ink-jet printing process according to the present invention, will hereinafter be described with reference to the drawings. Examples of the construction of a printing head, which is a main component of such an apparatus, are illustrated in FIGS. 4, 5 and 6. FIG. 4 is a cross-sectional view of a printing head taken along the flow path of ink, and FIG. 5 is a cross-sectional view taken along line 5—5 in FIG. 4. A printing head 13 is formed by bonding a plate made of glass, ceramic, plastic or the like having a groove 14 through which an ink is passed, to a heating head 15 (the construction of the heating head is not limited to the illustrated one). The heating head 15 is composed of a heat accumulating layer 19, a heating resistor layer 18 formed of nichrome or the like, electrodes 17-1 and 17-2 made of aluminum or the like and a protective layer, which have been laminated in that order on a substrate 20 made of alumina or the like having a good heat radiating property, and serves to generate heat at portions of the heating resistor layer 18 (portions in a region shown by n), on which the electrodes are not laminated, by energizing the electrodes 17-1 and 17-2, thereby applying thermal energy to an ink situated thereon.

Upon printing, an ink 21 is filled up to an ejection orifice 22, which is a minute opening situated at an end of the groove 14. When the electrodes 17-1 and 17-2 are energized in response to a printing signal in this state, the heating head 15 rapidly generates heat at the region shown by n to form bubbles in the ink 21 which is in contact with this region, and the ink 21 is ejected by the pressure thus produced from the orifice 22 toward printing paper 25 in the form of minute droplets 24.

FIG. 6 illustrates an appearance of a multi-head composed of an array of a number of heads as shown in FIG. 4. This multi-head is obtained by bonding a grooved plate 27 having a number of grooves 26, which define ink flow paths arranged side by side, to a heating head 28 formed in such a manner that the same heating regions (n) as illustrated in FIG. 4 are arranged at the predetermined positions in the respective grooves.

Figure 7:
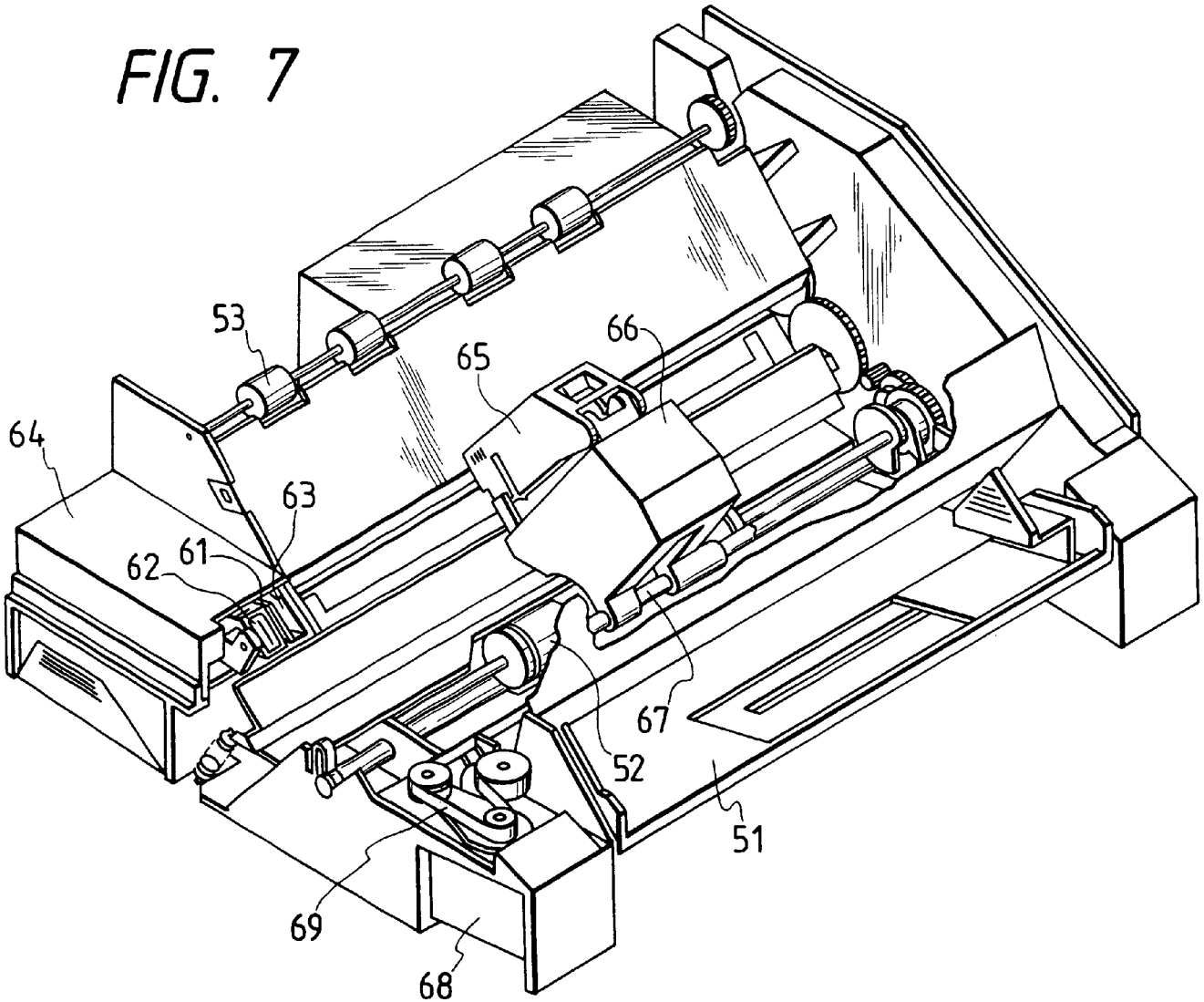
FIG. 7 is a perspective view schematically illustrating an ink-jet printing apparatus which may be used in a process according to the present invention.

FIG. 7 illustrates an example of an ink-jet printing apparatus in which such a multi-head as illustrated in FIG. 6 has been incorporated. In FIG. 7, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes into the course through which the printing head is moved. Reference numeral 62 indicates a cap, which is provided at the home position adjacent to the blade 61, and is so constituted that it moves in a direction perpendicular to a direction in which the printing head is moved and comes into contact with the face of ejection orifices to cap it. Reference numeral 63 denotes an ink-absorbing member provided adjoiningly to the blade 61 and, similar to the blade 61, held in such a form that it protrudes into the course through which the printing head is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the printing head which conducts printing in accordance with an ink-jet recording system and has a construction that an ink is ejected by, for example, thermal energy as illustrated in FIGS. 4 to 6. Reference numeral 66 indicates a carriage on which the printing head 65 is mounted so that the printing head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a paper feeding part from which the printing paper are separately inserted, and paper feed rollers driven by a motor (not illustrated), respectively. With such a construction, the printing paper is fed to the position opposite to the ejection opening face of the printing head, and discharged from a paper discharge section provided with paper discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement.

The above movement of the printing head 65 to its home position is made not only when the printing is completed or the printing head is recovered for ejection, but also when the printing head 65 is moved between printing regions for the purpose of printing, during which it is moved to the home position adjacent to each printing region at given intervals, where the ejection opening face is wiped in accordance with this movement.

In the case of color printing, printing may be performed by using either a printing head in which ejection orifices for cyan, magenta, yellow and black inks are arranged side by side, or printing heads for cyan, magenta, yellow and black inks arranged side by side. In this case, ejection of each of the color inks may be effected through one ejection orifice or through a plurality of ejection orifices so as to apply two or more ink droplets of the same color to the printing paper at the same time.

Figure 8:
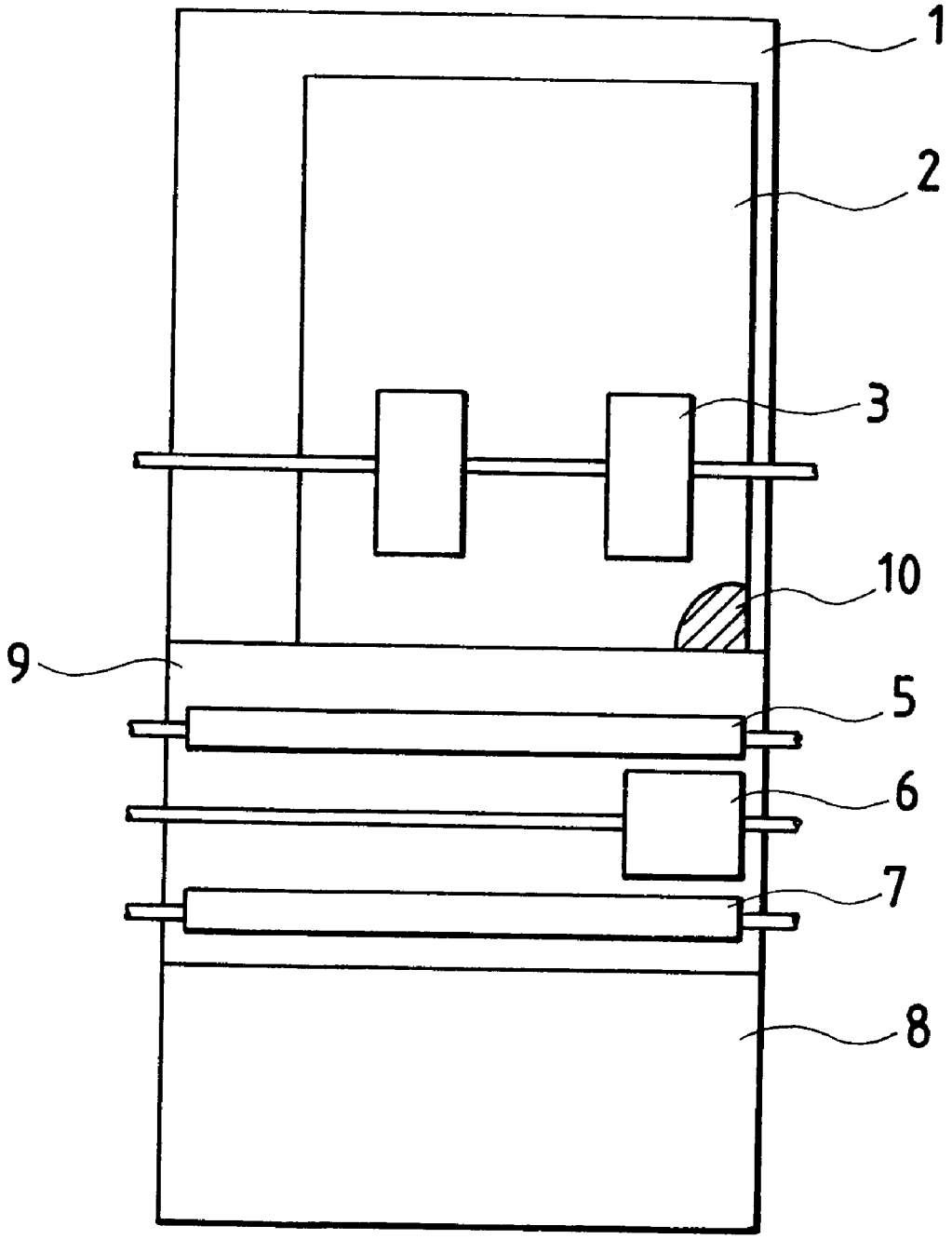
FIG. 8 typically illustrates a paper-feeding system in the printing apparatus.

FIG. 8 typically illustrates a paper feed mechanism. In FIG. 8, reference numeral 1 indicates a paper feed tray. Paper feed roller 3 (feeding means) in the form of a semi-cylinder are rotated counterclockwise, thereby bringing them into contact with the printing surface of the uppermost one of printing paper sheets 2 stacked on this tray. At this time, only a sheet of paper is separated by a separating claw 10 and fed to a platen. The method making use of the separating claw is well known. The separating claw 10 is constructed in such a manner that it is caught by a corner of a stack of the printing paper sheets, whereby only a sheet of paper is separated making use of the stiffness of the paper itself. Reference numeral 6 is an ink-jet head, 5 and 7 are feeding rollers, and 8 is a discharge tray.

The present invention will hereinafter be described more specifically by the following examples. Incidentally, all designations of "part" or "parts" as will be used in the following examples mean part or parts by weight unless expressly noted.

EXAMPLE 1

1) Preparation of Base Paper:

A base paper web for forming printing paper, having a basis weight of 80 g/m$^2$ and a Stöckigt sizing degree of 12 seconds was made in accordance with the method known per se in the art by mixing 90 parts of LBKP and 10 parts of NBKP as raw pulp, beating the mixture and then incorporating 7 parts of kaolin (product of Tsuchiya Kaolin Ind., Ltd.), 0.07 part of a neutral rosin size (Sizepine NT, trade name, product of Arakawa Chemical Industries, Ltd.) and 0.2 part of cationic starch into the mixture.

2) Preparation of Printing Paper:

A coating formulation was prepared by mixing components shown below in Table 1. The coating formulation was applied to a released process paper sheet (product of Nippon Kakoseishi K.K.) by an applicator and then dried at 50° C. to such an extent that it was semidried. The thus-coated paper sheet was laminated on one side of the base paper web made in the step 1) in such a manner that the coated surface thereof came into contact with the surface of the base paper web, and the laminate was pressed. Thereafter, the released process paper sheet was separated from the base paper web. A surface of the base paper web, to which the fine particles and the like had been transferred, was dried. The same process as described above was repeated on the other side of the base paper web, thereby obtaining Printing Paper 1-1 according to the present invention to both sides of which the fine particles and the like had been transferred. The dry coating weight of this printing paper was 4 g/m$^2$.

Scanning electron microphotographs of the surface of Printing Paper 1-1 are shown in FIG. 1 (250 magnifications) and FIG. 2 (2,000 magnifications). As apparent from FIG. 2, on the surface of the printing paper, the ultrafine particles were held on fibers in a state that their fibrous form was retained. The same holding state was observed on both sides.

TABLE 1

Composition of coating formulation for application

| Component | Composition (parts) |
|---|---|
| For Recording Paper 1-1 | |
| Ultrafine particles of synthetic silica (particle diameter: 30 nm, Aerosil MOX-80, trade name, product of Degussa) | 5 (solids) |
| Polyvinyl alcohol (PVA-GM-318, trade name, product of Kuraray Co., Ltd.) | 5 |
| Water | 90 |

Coating formulations prepared by mixing their corresponding components shown below in Table 2 were separately sprayed on both sides of the base paper web made in the step 1) and dried repeatedly so as to give a dry coating weight of 4 g/m$^2$, thereby obtaining Printing Paper 1-2 and 1-3 according to the present invention. The observation of both surfaces of the thus-obtained Printing Paper 1-2 and 1-3 through a scanning electron microscope revealed that the ultrafine particles were held on fibers in a state that their fibrous form was retained like Printing Paper 1-1.

TABLE 2

Composition of coating formulation for spraying

| Component | Composition (parts) |
|---|---|
| For Recording Paper 1-2 | |
| Ultrafine particles of alumina (Alumina Sol 520, trade name, particle size: 10 to 20 nm, product of Nissan Chemical Industries, Ltd.) | 2 (solids) |
| Polyvinyl alcohol (PVA-205, trade name, product of Kuraray Co., Ltd.) | 2 |
| Water | 96 |
| For Recording Paper 1-3 | |
| Ultrafine particles of titanium oxide (particle diameter: 10 nm, product of Taki Chemical Co., Ltd.) | 2 (solids) |
| Polyvinyl alcohol (PVA-205, trade name, product of Kuraray Co., Ltd.) | 2 |
| Water | 96 |

A coating formulation prepared by mixing components shown below in Table 3 was applied to both sides of the base paper web made in the step 1). This coating formulation became gel and nonfluid when it was left to stand. However, it was heated to 80° C. and stirred to reconstitute the coating formulation. This coating formulation was applied to both sides of the base paper web made in the step 1) by a bar coater and dried repeatedly so as to give a dry coating weight of 5 g/m$^2$, thereby obtaining Printing Paper 1-4 according to the present invention. The observation of both surfaces of the thus-obtained Printing Paper 1-4 through a scanning electron microscope revealed that the ultrafine particles were held on fibers in a state that their fibrous form was retained like Printing Paper 1-1.

TABLE 3

Composition of coating formulation for application

| Component | Composition (parts) |
|---|---|
| For Recording Paper 1-4 | |
| Ultrafine particles of silica (particle diameter: 40 to 60 nm, Snowtex XL, trade name, product of Nissan Chemical Industries, Ltd.) | 2 (solids) |
| Ultrafine particles of synthetic smectite (product of Co-op Chemical Co.) | 2 |
| Polyvinyl alcohol (PVA-CM-318, trade name, product of Kuraray Co., Ltd.) | 2 |
| Water | 94 |

3) Ink-jet Printing:

Their corresponding components shown below in Table 4 were mixed, and the resultant mixtures were separately filtered under pressure through a membrane filter (Fluoropore Filter, trade name; product of Sumitomo Electric Industries, Ltd.) having a pore size of 0.22 $\mu$m, thereby obtaining inks of yellow (Y), magenta (M), cyan (C) and black (Bk) colors.

TABLE 4

Composition of ink

| Ink | Component | Amount incorporated (parts) |
|---|---|---|
| Yellow | C.I. Direct Yellow 86 | 2 |
| | Thiodiglycol | 10 |
| | Glycerol | 7 |
| | Urea | 7 |
| | Acetylenol EH (trade name, product of Kawaken Fine Chemicals Co., Ltd.) | 1 |
| | Water (surface tension: 31 dyn/cm) | 73 |
| Magenta | C.I. Acid Red 289 | 2.5 |
| | Thiodiglycol | 10 |
| | Glycerol | 7 |
| | Urea | 7 |
| | Acetylenol EH (trade name, product of Kawaken Fine Chemicals CO., Ltd.) | 1 |
| | Water (surface tension: 31 dyn/cm) | 72.5 |
| Cyan | C.I. Acid Blue 9 | 2.5 |
| | Thiodiglycol | 10 |
| | Glycerol | 7 |
| | Urea | 7 |
| | Acetylenol EH (trade name, product of Kawaken Fine Chemicals Co., Ltd.) | 1 |
| | Water (surface tension: 31 dyn/cm) | 72.5 |
| Black | C.I. Food Black 2 | 3 |
| | Thiodiglycol | 10 |
| | Glycerol | 7 |
| | Urea | 7 |
| | Acetylenol EH (trade name, product of Kawaken Fine Chemicals Co., Ltd.) | 1 |
| | Water (surface tension: 31 dyn/cm) | 72 |

Using the above printing papers 1-1 to 1-4 and inks (4 kinds), color images were formed (printed) on both sides of each of the printing paper samples by means of an ink-jet printing apparatus equipped with drop-on-demand ink-jet heads of an ink-jet system having 16 nozzles per mm in which droplets of inks are ejected by applying thermal energy, thereby evaluating the resulting images as to the following items. The evaluation results obtained as to the individual printing paper samples are shown in Table 6.

1. Optical Density:

A solid print of 100% duty, in which dots were formed in all pixels, was formed by printing with each of the black, yellow, cyan and magenta inks. After the print sample was left over for 12 hours, its optical density was measured by means of a reflection densitometer (Macbeth RD918, trade name, manufactured by Macbeth Co.).

2. Resistance to Bleeding:

Solid areas of 100% duty, in which dots were formed in all pixels of black, yellow, magenta, cyan, blue, green and red, were printed in contiguity with one another. The thus-obtained print sample was visually observed as to the degree of running and uneven color mixing (bleeding) occurred at boundaries between the respective colors, and the resistance to bleeding was ranked as AA where each boundary was distinct and legible as a straight line, A where the boundary was distinct, but its linearity was somewhat poor, C where the inks mixed with each other, and so the boundary therebetween was illegible, or B where the degree of bleeding was between the ranks A and C.

COMPARATIVE EXAMPLES 1-1

Using paper for PPC (L paper, trade name, product of FUJI XEROX Inc.) as Printing Paper 1-5 as it is, ink-jet printing was conducted in the same manner as in Example 1 to evaluate its printability. The results obtained are shown in Table 6.

COMPARATIVE EXAMPLES 1-2

A coating formulation was prepared by mixing components shown below in Table 5, applied by a bar coater to one side of the base paper web made in Example 1 so as to give a dry coating weight of 10 g/m$^2$, and then dried, thereby obtaining Printing Paper 1-6.

TABLE 5

Composition of coating formulation for application

| Component | Composition (parts) |
|---|---|
| For Recording Paper 1-6 | |
| Fine particles of silica (average particle diameter: 12 μm, Sylysia 470, trade name, product of Fuji Silisia K.K.) | 10 |
| Polyvinyl alcohol (Gohsenol NL-06, trade name, product of The Nippon Synthetic Chemical Industry Co., Ltd.) | 4 |
| Water | 86 |

Using the thus-obtained Printing Paper 1-6, ink-jet printing was conducted in the same manner as in Example 1 to evaluate its printability. The results obtained are shown in Table 6.

TABLE 6

(Results of evaluation)

| Ex. | Comp. Ex. | No. of printing paper | Results of evaluation: Optical density: Black | Cyan | Magenta | Yellow | Resistance to bleeding |
|---|---|---|---|---|---|---|---|
| 1 | | 1-1 | 1.34 | 1.38 | 1.51 | 1.25 | AA |
| | | | 1.36 | 1.38 | 1.41 | 1.29 | AA |
| 1 | | 1-2 | 1.32 | 1.34 | 1.38 | 1.25 | A |
| | | | 1.34 | 1.39 | 1.38 | 1.26 | A |
| 1 | | 1-3 | 1.33 | 1.37 | 1.38 | 1.26 | A |
| | | | 1.34 | 1.38 | 1.38 | 1.25 | A |
| 1 | | 1-4 | 1.34 | 1.34 | 1.39 | 1.27 | A |
| | | | 1.33 | 1.37 | 1.38 | 1.26 | A |
| | 1-1 | 1-5 | 1.12 | 1.11 | 1.26 | 1.10 | C |
| | | | 1.11 | 1.11 | 1.24 | 1.12 | C |
| | 1-2 | 1-6* | 1.33 | 1.34 | 1.32 | 1.25 | AA |
| | | | 0.96 | 0.99 | 1.05 | 0.89 | B |

Evaluation was conducted on both sides of each printing paper sample.
*The upper row of Printing Paper 1–6 shows the results as to the coated surface.

As apparent from the example and comparative examples described above, the printing paper according to the present invention can achieve high optical density even in color ink-jet printing and has excellent ink-jet printability such as the prevention of occurrence of bleeding. In addition, since the printing paper of the present invention is not provided with a coating layer unlike the conventional coated paper for ink-jet printing and is so constructed that the fine particles, which mainly captures a coloring material in an ink, are held on the surfaces of fibers exposed on the paper surface in a state that their fibrous form is retained, the falling off of the fine particle from the paper surface, i.e., dusting, scarcely occurs, so that occurrence of defective paper feed can be prevented even when it is used many times in a recording apparatus, and printing can hence be performed smoothly. In the printing paper according to the present invention, both surfaces thereof can be used in printing. Further, the printing paper has a feeling and handleability comparable to plain paper, is good in writing quality upon writing with a pencil and can be used as toner-transfer paper for electrophotographic recording.

EXAMPLE 2

[Preparation of Base Paper]

Base Paper Web A having a basis weight of 82 g/m$^2$ was made in accordance with the method known per se in the art by incorporating 10 parts of kaolin (product of Tsuchiya Kaolin Ind., Ltd.) and 0.2 part of cationic starch into a mixture of 80 parts of LBKP and 20 parts of NBKP beaten to C.S.F. of 430 ml as raw pulp.

Base Paper Web B having a basis weight of 80 g/m$^2$ was made in accordance with the method known per se in the art by incorporating 10 parts of kaolin (product of Tsuchiya Kaolin Ind., Ltd.), 0.3 part of cationic starch, 0.1 part of aluminum sulfate and 0.05 part of a neutral rosin size (Sizepine NT, trade name, product of Arakawa Chemical Industries, Ltd.) into the above mixture.

Base Paper Webs C and D-were made in the same manner as in Base Paper Web B except that the amounts of the neutral rosin size were changed to 0.2 part and 0.4 part, respectively.

Base Paper Web E was made in the same manner as in Base Paper Web B except that kaolin in Base Paper Web B was changed to precipitated calcium carbonate (TP-121, trade name, product of OKUTAMAKOGYO CO., LTD.), the amounts of cationic starch and the neutral rosin size (Sizepine NT, trade name, product of Arakawa Chemical Industries, Ltd.) were changed to 0.5 part and 0.03 part, respectively, and 0.2 part of polyacrylamide (product of Harima Chemicals, Inc.) was used in place of aluminum sulfate.

[Preparation of Printing Paper]

The following Coating Formulation 2-1 was applied to Base Paper Web A in the same manner as in Printing Paper 1-1 of Example 1 so as to give a dry coating weight of 3 g/m$^2$, thereby preparing Printing Paper 2-1.

Coating Formulation 2-1 was applied to Base Paper Web B in the same manner as described above so as to give a dry coating weight of 2 g/m$^2$, thereby preparing Printing Paper 2-2.

The following Coating Formulation 2-2 was applied to Base Paper Web C in the same manner as described above so as to give a dry coating weight of 2 g/m$^2$, thereby preparing Printing Paper 2-3.

Coating Formulation 2-1 was applied to Base Paper Web B in the same manner as described above so as to give a dry coating weight of 4 g/m$^2$, thereby preparing Printing Paper 2-4.

| Coating Formulation 2-1: | |
|---|---|
| Ultrafine particles of synthetic silica (Aerosil MOX-80, trade name, product of Degussa) | 2 parts |
| Polyvinyl alcohol (PVA-205, trade name, product of Kuraray Co., Ltd.) | 2 parts |
| Water | 96 parts. |

Coating Formulation 2-2

Prepared in the same manner as in Coating Formulation 2-1 except that silica in Coating Formulation 2-1 was changed to pseudo-boehmite (AS-3, trade name, product of Catalysts & Chemicals Industries Co., Ltd.).

The following Coating Formulation 2-3 was applied to Base Paper Web E in the same manner as in Printing Paper 1-1 of Example 1 so as to give a dry coating weight of 3 g/m$^2$, thereby preparing Printing Paper 2-5.

| Coating Formulation 2-3: | |
|---|---|
| Alumina (AKP-G015, trade name, product of Sumitomo Chemical Co., Ltd. | 10 parts |
| Polyvinyl alcohol (PVA-205, trade name, product of Kuraray Co., Ltd.) | 10 parts |
| Polyallylamine hydrochloride (PAA-HCL-3L, product of Nitto Boseki Co., Ltd.) | 1 part |
| Water | 79 parts. |

The surface configurations of these printing paper sheets were observed through a scanning electron microscope. As a result, it was recognized that the fine particles were held on fibers in a state that their fibrous form was retained.

| [Composition of ink] | |
|---|---|
| Ink A (surface tension: 30 dyn/cm) | |
| Dye | x parts |
| Glycerol | 5.0 parts |
| Thiodiglycol | 10.0 parts |
| Acetylenol | 1.0 parts |
| Water | Balance. |
| [Dye] | |
| Black: C.I. Food Black 2 | 3.5 parts |
| Yellow: C.I. Direct Yellow 86 | 2.0 parts |
| Magenta: C.I. Acid Red 289 | 2.5 parts |
| Cyan: C.I. Acid Blue 199 | 2.5 parts. |
| Ink B (surface tension: 48 dyn/cm) | |
| Dye | x parts |
| Glycerol | 5.0 parts |
| Thiodiglycol | 5.0 parts |
| Isopropyl alcohol | 4.0 parts |
| Urea | 5.0 parts |
| Water | Balance. |
| [Dye] | |
| Black: C.I. Food Black 2 | 3.5 parts |
| Yellow: C.I. Direct Yellow 86 | 2.0 parts |
| Magenta: C.I. Acid Red 35 | 2.5 parts |
| Cyan: C.I. Direct Blue 199 | 2.5 parts. |

[Printing apparatus]

Printing was conducted by means of a printing apparatus equipped with printing heads of an ink-jet system in which thermal energy is used as an ejection source for ink, thereby evaluating printability. As the printing apparatus, the following two apparatus were used.

Printing Apparatus 1:

A printing apparatus equipped with printing heads of a drop-on-demand type ink-jet system having 14 nozzles per mm in which thermal energy is used as an ejection source for ink. An average volume of ink droplets ejected by each of the printing heads for the respective colors were measured. As a result, it was found to be as follows:

Black: 40 pl

Cyan: 38 pl

Magenta: 41 pl

Yellow: 39 pl.

Printing Apparatus 2:

A printing apparatus equipped with printing heads having 14 nozzles per mm. An average volume of ink droplets ejected by each of the printing heads for the respective colors were measured. As a result, it was found to be as follows:

Black: 79 pl

Cyan: 40 pl

Magenta: 38 pl

Yellow: 41 pl.

Using the above printing apparatus, a color image was printed on each of the printing paper samples, thereby evaluating the resulting images as to the following items. The evaluation was conducted in accordance with the following methods. The results of the evaluation are shown in Table 7.

[Evaluation Item]

1. Optical Density:

A solid print of 100% duty was formed with the black ink. After the print sample was left over for 12 hours, its reflection density was measured by means of a reflection densitometer (Macbeth RD-918, trade name, manufactured by Macbeth Co.).

2. Resistance to Bleeding:

Solid areas of black, yellow, magenta, cyan, blue, green and red were printed in contiguity with one another. The thus-obtained print sample was visually observed as to the degree of bleeding occurred at boundaries between the respective colors, and the resistance to bleeding was ranked as AA where each boundary was distinct and legible as a straight line, A where the boundary was distinct, but its linearity was somewhat poor, B where the inks mixed each other, and so the boundary was indistinct, or C where the boundary was illegible.

3. Quality of Character:

Complicated Kanji characters, such as "[illegible]" and "[illegible]", of black, yellow, magenta, cyan, blue, green and red colors were printed to visually evaluate the quality of character. The quality of character was ranked as A where the characters formed were distinct and sharp in edge, B where the characters were somewhat indistinct in edge, but legible, or C where the characters were deformed and illegible, or markedly poor in quality.

TABLE 7

(Results of evaluation)

| | Printing paper | Contact time, Th 3) $msec^{1/2}$ | Wetting time, tw 4) $msec^{1/2}$ | Roughness index, Kr 4) $m1/m^2$ | Absorption coefficient, $m1(m^2 \cdot msec^{1/2})$ | Printer | Ink | Evaluation result: Optical density | Resistance to bleeding | Character quality |
|---|---|---|---|---|---|---|---|---|---|---|
| Ref. | 2-1 | 2.8 | Un- | Un- | 0.9 and 3.0 | 1 | A | 1.40 | A | B |
| Ex. | | | measur- | measur- | | 1 | B | 1.48 | A | B |
| 2-1 | | | able | able | | 2 | Bk:B, CMY:A | 1.55 | A | B |
| Ex. 2 | 2-2 | 3.4 | 3.2 | 8.2 | 2.3 | 1 | A | 1.42 | A | A |
| | | | | | | 1 | B | 1.53 | A | A |
| | | | | | | 2 | Bk:B, CMY:A | 1.63 | A | AA[2)] |
| Ref. | 2-3 | 4.0 | 4.9 | 6.8 | 1.7 | 1 | A | 1.49 | A | A |
| Ex. | | | | | | 1 | B | 1.30 | B | B |
| 2-2 | | | | | | 2 | Bk:B, CMY:A | 1.38 | B[1)] | B |
| Ex. 2 | 2-4 | 3.2 | 2.3 | 7.6 | 2.3 | 1 | A | 1.44 | A | A |
| | | | | | | 1 | B | 1.59 | A | A |
| | | | | | | 2 | Bk:B, CMY:A | 1.68 | A | AA |
| Ex. 2 | 2-5 | 4.0 | 4.3 | 6.7 | 1.9 | 1 | A | 1.47 | A | A |
| | | | | | | 1 | B | 1.61 | A | A |
| | | | | | | 2 | Bk:B, CMY:A | 1.70 | A | AA |
| Comp. | L Paper | None | 5.1 | 7.3 | 0.9 | 1 | A | 1.00 | C | C |
| Ex. | | | | | | 1 | B | 1.05 | C | C |
| 2-1 | | | | | | 2 | Bk:B, CMY:A | 1.18 | C | C |
| Comp. | STANDARD | None | Un- | Un- | 1.8 | 1 | A | 1.43 | A | B |
| Ex. | | | measur- | measur- | | 1 | B | 1.47 | A | B |
| 2-2 | | | able | able | | 2 | Bk:B, CMY:A | 1.56 | A | B |

[1)]Boundary was definite between the color inks but somewhat indefinite between the black ink and the color inks.
[2)]AA indicates that quality of black characters in particular is good.
3) Measured by using Ink A.
4) Measured by using Ink B.

[Effects of the Embodiments of the Present Invention]

With reference to Table 7, the effects of the present invention will be described specifically.

Recording Paper 2-2, 2-4 and 2-5, the contact time Th, wetting time tw, roughness index Kr and absorption coefficient Ka values of which satisfy the above respective conditions (the contact time Th is not shorter than 2, the wetting time tw is not shorter than 2 but not longer than 4.5, the roughness index Kr is not smaller than 5 and the absorption coefficient Ka is not greater than 5), can provide good images having a high optical density and scarcely causing bleeding with characters distinct in edge using both Inks A and B.

Comparative Example 2-1 the absorption coefficient Ka1 of which is 0 when measured with Ink A and the contact time Th of which is not detected, can provide no satisfactory images using both Inks A and B. Referential Examples 2-1 and Comparative Example 2-2, the wetting time tw of which are too short to measure, tend to cause feathering because of its too good initial ink absorbency, so that the character quality of images printed are deteriorated. Referential Example 2-2 (Printing Paper 2-3), the wetting time tw of which is long, provides an image deteriorated in character quality with Ink B. Referential Examples 2-1 (Printing Paper 2-1), the contact time Th of which is not shorter than 2, but the wetting time tw of which is too short to measure when measured with Ink B, tends to cause feathering because of its too good absorbency, so that the character quality of images printed are deteriorated.

Comparative Example 2-1 is a case where L paper (trade name, product of FUJI XEROX Inc.), which is general paper for electrophotography, is used as printing paper. The surface of this printing paper is covered throughout with pulp fibers. In this case, unsatisfactory images can be only provided in all respects.

Comparative Example 2-2 is a case where coated paper (STANDARD, trade name) for ink-jet made by KAO K.K., which is the conventional coated paper for ink-jet, is used as printing paper. The surface of this printing paper is covered throughout with a pigment, and so no pulp fiber is recognized on the surface. Therefore, this paper lacks a feeling of plain paper to a marked extent and offers a problem of dusting or the like when using many times. This paper has three absorption coefficients when measured with Ink A, and its initial absorption coefficient is great. Further, its wetting time is too short to measure when measured with Ink B, and hence has too good initial ink absorbency to cause feathering, so that the character quality of images printed are deteriorated.

As apparent from Example 2, Referential Examples 2-1 and 2-2, and Comparative Examples 2-1 and 2-2, the printing paper according to the present invention and the printing process using such printing paper permit, as paper for full-color ink-jet printing, the formation of bright images high in resolution, good in water fastness and similar to those formed on coated paper. In particular, good images can be provided even when printing is conducted using inks having a high surface tension and ink having a low surface tension in combination.

This printing paper does not generate dust caused by falling off of a coating layer and has a feeling of plain paper.

Further, this printing paper can also be used as printing paper for electrophotographic system, thermal transfer recording and impact system and also as paper for writing with pencils and the like, hence has high flexibility, and is low in cost compared with coated paper.

Example 3

[Preparation of Base Paper]

A base paper web having a basis weight of 80 $g/m^2$ and a Stöckigt sizing degree of 14 seconds was made in accordance with the method known per se in the art by mixing 90 parts of LBKP and 10 parts of NBKP as raw pulp, beating the mixture and then incorporating 7 parts of kaolin (product of Tsuchiya Kaolin Ind., Ltd.), 0.07 part of a neutral rosin size (Sizepine NT, trade name, product of Arakawa Chemical Industries, Ltd.) and 0.2 part of cationic starch into the mixture.

[Preparation of Printing Paper]

coating Formulation 3-1 prepared by mixing components described below was sprayed by an air sprayer on both sides of the base paper web made in the above step and dried repeatedly so as to give a dry coating weight of 4 g/m$^2$, thereby obtaining Printing Paper 3-1 according to the present invention. The surface configuration of this printing paper was observed through a scanning electron microscope. As a result, it was recognized that the fine particles were held on the surfaces of pulp fibers, and the fibrous form of the fibers was retained. The retention of frictional force of this printing paper determined in accordance with the above-described method is shown in Table 8.

Coating Formulation 3-1

| | |
|---|---|
| Ultrafine particles of yttrium oxide (particle diameter: about 4 nm, product of Taki Chemical Co., Ltd.) | 2 parts (solids) |
| Polyvinyl alcohol (PVA-205, trade name, product of Kuraray Co., Ltd.) | 2 parts |
| Water | 96 parts. |

Printing Paper 3-2 was made in the same manner as in Printing Paper 3-1 except that Coating Formulation 3-2 having the following composition was used. The surface configuration of this printing paper was the same as in Printing Paper 3-1.

Coating Formulation 3-2

| | |
|---|---|
| Ultrafine particles of cerium oxide (particle diameter: about 5 nm, product of Taki Chemical Co., Ltd.) | 2 parts (solids) |
| Polyvinyl alcohol (PVA-205, trade name, product of Kuraray Co., Ltd.) | 2 parts |
| Water | 96 parts. |

Coating Formulation 3-3 having the following composition was prepared.

Coating Formulation 3-3

| | |
|---|---|
| Ultrafine particles of cationized silica (particle diameter: about 20 nm, Snowtex AL, trade name, product of Nissan Chemical Industries, Ltd.) | 4 parts (solids) |
| Hydroxyethylcellulose (HEC-AH-15, trade name, product of Fuji Chemical K.K.) | 4 parts |
| Water | 92 parts. |

Since the coating formulation was in the form of gel, it was applied to both sides of the base paper web made in the above step by a bar coater with heating and stirring and dried repeatedly so as to give a dry coating weight of 5 g/m$^2$, thereby obtaining Printing Paper 3-3. The surface configuration of this printing paper was the same as in Printing Paper 3-1.

Coating Formulation 3-4 having the following composition was prepared.

Coating Formulation 3-4

| | |
|---|---|
| Ultrafine particles of alumina (particle diameter: about 20 nm, Aerosil Aluminium oxide-C, trade name, product of Degussa) | 10 parts |
| Polyvinyl alcohol (PVA-CM-318, trade name, product of Kuraray Co., Ltd.) | 10 parts |
| Water | 80 parts. |

The coating formulation was applied once to a released process paper sheet (product of Nippon Kakoseishi K.K.) and then dried at 50° C. to such an extent that it was semidried. The thus-coated paper sheet was laminated on one side of the base paper web made in the above step in such a manner that the coated surface thereof came into contact with the surface of the base paper web. After the released paper sheet was separated from the base paper web, the transferred coating formulation was dried. This process was repeated on both sides of the base paper web, thereby obtaining Printing Paper 3-4 having a dry coating weight of 4 g/m$^2$. The surface configuration of this printing paper was the same as in Printing Paper 3-1.

Comparative Example 3-1

Paper for PPC (L paper, trade name, product of FUJI XEROX Inc.) was used as comparative Printing Paper 3-5 as it is.

Comparative Examples 3-2

Coating Formulation 3-5 was prepared by mixing the following components.

Coating Formulation 3-5

Secondary aggregate fine powder of silica 10 parts (particle diameter: about 3 $\mu$m, Sylysia 470, trade name, product of Fuji Silisia K.K.)

Polyvinyl alcohol (Gohsenol NL-06, trade 4 parts name, product of The Nippon Synthetic Chemical Industry Co., Ltd.)

Water 86 parts.

This coating formulation was applied by a bar coater to one side of the base paper web made in Example 3 so as to give a dry coating weight of 10 g/m$^2$, and then dried, thereby obtaining comparative Printing Paper 3-6.

Their corresponding components described below were then mixed, and the resultant mixtures were separately filtered under pressure through a membrane filter (Fluoropore Filter, trade name; product of Sumitomo Electric Industries, Ltd.) having a pore size of 0.22 $\mu$m, thereby obtaining yellow, magenta, cyan and black inks (3)-Y, (3)-M, (3)-C and (3)-Bk. (3)-Y:

| | |
|---|---|
| C.I. Direct Yellow 86 | 2.5 parts |
| Thiodiglycol | 10.0 parts |
| Glycerol | 7.0 parts |
| Urea | 7.0 parts |
| Acetylenol EH (trade name, product of Kawaken Fine Chemicals Co., Ltd.) | 1.0 part |
| Water | Balance. |

(3)-M:

The same composition as in (3)-Y except that the dye was changed to 3 parts of C.I. Acid Red 289.

(3)-C:

The same composition as in (3)-Y except that the dye was changed to 3 parts of C.I. Acid Blue 9.

(3)-Bk:

The same composition as in (3)-Y except that the dye was changed to 3.5 parts of C.I. Food Black 2.

These inks each had a surface tension of 32 dyn/cm.

Using the printing paper and inks thus obtained, color images were formed by means of an ink-jet printing apparatus equipped with printing heads of a drop-on-demand type ink-jet system having 14 nozzles per mm in which droplets of inks are ejected by applying thermal energy, thereby evaluating the resulting images. Printing conditions were as follows:

Drive frequency: 6 kHz.

Ejection quantity: 45 pl

Printing density: 9 nl/mm$^2$ at the greatest per single color.

The evaluation of the printed images was conducted on both sides of each printing paper sample in accordance with the following methods. The results obtained are shown in Table 8.

1) Retention of Frictional Force:

Frictional force (F1) between a rubber plate (EPDM) and the surface of a printing paper sample was first measured under a load of 40 g/cm$^2$. After rubbing between the rubber plate and the surface of the printing paper sample was then conducted 20 times under the same load, frictional force (F2) was measured in the same manner as described above. The measurement was conducted by means of a digital force gage (DFG-2K, trade name, manufactured by Shimpo Kogyo K.K.). From the respective frictional force values obtained in such a way, retention of frictional force (F) in terms of percentage was determined in accordance with the following equation.

$$F=F2/F1$$

The greater value of F of the printing paper sample indicates that the frictional force of the printing paper sample is not very reduced even when it is used repeatedly many times in a printing apparatus, and so trouble of feeding is hard to occur.

2) Optical Density:

A solid print of 100% duty was formed with each of the black, yellow, cyan and magenta inks. After the print sample was left over for 12 hours, its reflection density was measured by means of a reflection densitometer (Macbeth RD918, trade name, manufactured by Macbeth Co.).

3) Resistance to Bleeding:

Solid areas of black, yellow, magenta, cyan, blue, green and red were printed in contiguity with one another. The thus-obtained print sample was visually observed as to the degree of bleeding occurred at boundaries between the respective colors, and the resistance to bleeding was ranked as A where the boundary was legible as a straight line, or C where the inks mixed with each other at the boundaries.

4) Feedability:

Printing was continuously conducted with the printing paper made above. The conveyability of each printing paper sample was ranked as A where continuous printing was feasible to 2000 sheets of paper, or C where continuous printing was not feasible to such an extent.

5) Suitability for Plain Paper:

The suitability of each printing paper sample for plain paper was ranked as A where it was near a feeling of plain paper to look at and writable with mechanical pencils, ball point pens, felt-tip pens, etc. like plain paper, or C where it was not so good.

TABLE 8

| | | | | Results of evaluation | | | | | | |
|---|---|---|---|---|---|---|---|---|---|---|
| | Comp. | No. of printing | Retention of frictional | Optical density | | | | Resistance | | Suitability for plain |
| Ex. | Ex. | paper | force (%) | Black | Cyan | Magenta | Yellow | to bleeding | Feedability | paper |
| 3 | | 3-1 | 93 | 1.32 | 1.34 | 1.38 | 1.25 | A | A | A |
| | | | 93 | 1.34 | 1.39 | 1.38 | 1.26 | A | A | A |
| 3 | | 3-2 | 89 | 1.33 | 1.37 | 1.38 | 1.26 | A | A | A |
| | | | 89 | 1.34 | 1.38 | 1.38 | 1.25 | A | A | A |
| 3 | | 3-3 | 85 | 1.39 | 1.39 | 1.44 | 1.32 | A | A | A |
| | | | 84 | 1.38 | 1.42 | 1.43 | 1.31 | A | A | A |
| 3 | | 3-4 | 82 | 1.39 | 1.43 | 1.51 | 1.30 | A | A | A |
| | | | 82 | 1.40 | 1.43 | 1.46 | 1.34 | A | A | A |
| | 3-1 | 3-5 | 96 | 1.13 | 1.12 | 1.27 | 1.11 | C | A | A |
| | | | 97 | 1.12 | 1.12 | 1.25 | 1.13 | C | A | A |
| | 3-2 | 3-6* | 56 | 1.35 | 1.36 | 1.34 | 1.27 | A | C | C |
| | | | 96 | 1.06 | 1.09 | 1.15 | 1.04 | C | C | A |

Evaluation was conducted on both sides of each printing paper sample.

*The upper row of Printing Paper 3–6 shows the results as to the coated surface.

As apparent from Example 3 and Comparative Examples 3-1 and 3-2, the use of the printing paper according to the present invention in color ink-jet printing made it possible to provide very bright images high in optical density and free of bleeding. Further, in the printing paper according to the present invention, a good image can be formed even when printing is conducted on either surface. Besides, since the printing paper according to the present invention is not provided with a special coating unlike the prior art, it undergoes no defective paper feed even when it is used many times in any printing apparatus, has a feeling comparable to plain paper and is good in writing quality upon writing with a pencil.

EXAMPLE 4

[Preparation of Base Paper]

A base paper web having a basis weight of 80 g/m$^2$ was made in accordance with the method known Per se in the art by mixing 90 parts of LBKP and 10 parts of NBKP as raw pulp, beating the mixture and then incorporating 7 parts of kaolin (product of Tsuchiya Kaolin Ind., Ltd.), 0.07 part of a neutral rosin size (Sizepine NT, trade name, product of Arakawa Chemical Industries, Ltd.) and 0.2 part of cationic starch into the mixture.

[Preparation of Printing Paper]

Coating Formulation 4-1-1 prepared by mixing components described below was sprayed by an air sprayer on both sides of the base paper web made in the above step and dried repeatedly so as to give a dry coating weight of 4 g/m$^2$. Similarly, Coating Formulation 4-1-2 composed of components described below was further sprayed by an air sprayer on the coated surfaces of both sides and dried repeatedly so as to give a dry coating weight of 2 g/m$^2$, thereby obtaining Printing Paper 4-1 according to the present invention. The surface configuration of this printing paper was observed through a scanning electron microscope. As a result, it was recognized that the fine particles were held on the surfaces of pulp fibers, and the fibrous form of the fibers was retained. The degree of show-through of this printing paper determined in accordance with the above-described method is shown in Table 9. The thus-obtained printing paper had a sizing degree of 14 seconds.

Coating Formulation 4-1-1

| | |
|---|---|
| Ultrafine particles of yttrium oxide (particle diameter: about 4 nm, product of Taki Chemical Co., Ltd.) | 2 parts (solids) |
| Polyvinyl alcohol (PVA-205, trade name, product of Kuraray Co., Ltd.) | 2 parts |
| Water | 96 parts. |

Coating Formulation 4-1-2

| | |
|---|---|
| Polyallylamine hydrochloride (PAA-HCl-10L, trade name, product of Nitto Boseki Co., Ltd.) | 0.8 part |
| Benzalkonium chloride (G-50, trade name, product of Sanyo Chemical Industries, Ltd.) | 0.2 part |
| Water | 99 parts. |

Printing Paper 4-2 was made in the same manner as in Printing Paper 4-1 except that Coating Formulation 4-2 having the following composition was used in place of Coating Formulation 4-1-1. The thus-obtained printing paper had a sizing degree of 14 seconds. The surface configuration of this printing paper was the same as in Printing Paper 4-1.

Coating Formulation 4-2

| | |
|---|---|
| Ultrafine particles of cerium oxide (particle diameter: about 5 nm, product of Taki Chemical Co., Ltd.) | 2 parts (solids) |
| Polyvinyl alcohol (PVA-205, trade name, product of Kuraray Co., Ltd.) | 2 parts |
| Water | 96 parts. |

Coating Formulation 4-3 having the following composition was prepared.

Coating Formulation 4-3

| | |
|---|---|
| Ultrafine particles of cationized silica (particle diameter: about 20 nm, Snowtex AL, trade name, product of Nissan Chemical Industries, Ltd.) | 4 parts (solids) |
| Hydroxyethylcellulose (HEC-AH-15, trade name, product of Fuji Chemical K.K.) | 3 parts |
| Polyallylamine (PAA-10C, trade name, product of Nitto Boseki Co., Ltd.) | 2 parts |
| Water | 91 parts. |

Since the coating formulation was in the form of gel, it was applied to both sides of the base paper web made in the above step by a bar coater with heating and stirring and dried repeatedly so as to give a dry coating weight of 5 g/m$^2$, thereby obtaining Printing Paper 4-3. The thus-obtained printing paper had a sizing degree of 16 seconds. The surface configuration of this printing paper was the same as in Printing Paper 4-1.

Coating Formulation 4-4 having the following composition was prepared.

Coating Formulation 4-4

| | |
|---|---|
| Ultrafine particles of alumina (particle diameter: about 20 nm, Aerosil Aluminium oxide-C, trade name, product of Degussa) | 10 parts |
| Polyvinyl alcohol (PVA-CM-318, trade name, product of Kuraray Co., Ltd.) | 6 parts |
| Polyallylamine hydrochloride (PAA-HCl-3L, trade name, product of Nitto Boseki Co., Ltd.) | 3 parts |
| Aluminum lactate (Takiseram, trade name, (product of Taki Chemical Co., Ltd.) | 1 part |
| Water | 80 parts. |

The coating formulation was applied once to a released process paper sheet (product of Nippon Kakoseishi K.K.) and then dried at 50° C. to such an extent that it was semidried. The thus-coated paper sheet was laminated on one side of the base paper web made in the above step in such a manner that the coated surface thereof came into contact with the surface of the base paper web. After the released paper sheet was separated from the base paper web, the transferred coating formulation was dried. This process was repeated on both sides of the base paper web, thereby obtaining Printing Paper 4-4 having a dry coating weight of 4 g/m$^2$. The thus-obtained printing paper had a sizing degree of 18 seconds. The surface configuration of this printing paper was the same as in Printing Paper 4-1.

Comparative Example 4-1

Paper for PPC (L paper, trade name, product of FUJI XEROX Inc.) was used as comparative Printing Paper 4-5 as it is.

REFERENTIAL EXAMPLE 4-1

Coating Formulation 4-5 having the following composition was prepared.

Coating Formulation 4-5

| | |
|---|---|
| Ultrafine particles of cationized silica (Snowtex AK, trade name, product of Nissan Chemical Industries, Ltd.) | 2 parts (solids) |
| Polyvinyl alcohol (PVA-105, trade name, product of Kuraray Co., Ltd.) | 2 parts |
| Water | 96 parts. |

This coating formulation was applied to both sides of the base paper web made in the above step by a bar coater and dried so as to give a dry coating weight of 5 g/m$^2$, thereby obtaining Printing Paper 4-6. The thus-obtained printing paper had a sizing degree of 18 seconds.

COMPARATIVE EXAMPLES 4-2

Coating Formulation 4-6 was prepared by mixing the following components.

Coating Formulation 4-6

| | |
|---|---|
| Fine powder of silica (Mizukasil P-78, trade name, average particle diameter: about 7 $\mu$m, product of Mizusawa Industrial Chemicals, Ltd.) | 10 parts |
| Polyvinyl alcohol (PVA-CM-318, trade name, product of Kuraray Co., Ltd.) | 6 parts |
| Polyallylamine hydrochloride (PAA-HCl-3L, trade name, product of Nitto Boseki Co., Ltd.) | 3 parts |
| Benzalkonium chloride (G-50, trade name, product of Sanyo Chemical Industries, Ltd.) | 1 part |
| Water | 80 parts. |

This coating formulation was applied by a bar coater to one side of the base paper web made in Example 4 so as to give a dry coating weight of 5 g/m$^2$, and then dried, thereby obtaining comparative Printing Paper 4-7. The thus-obtained printing paper had a sizing degree of 17 seconds.

COMPARATIVE EXAMPLES 4-3

Printing Paper 4-8 was made in the same manner as in Printing Paper 4-1 except that the base material was changed to a white polyethylene terephthalate film having a thickness of 100 $\mu$m (Mellinex, trade name, product of ICI, Ltd.).

REFERENTIAL EXAMPLE 4-2

Printing Paper 4-9 was made in the same manner as in Printing Paper 4-1 except that filter paper (Toyo Filter Paper No. 4) was used as the base paper web. The thus-obtained printing paper had a sizing degree of 0 second.

Their corresponding components described below were then mixed, and the resultant mixtures were separately filtered under pressure through a membrane filter (Fluoropore Filter, trade name; product of Sumitomo Electric Industries, Ltd.) having a pore size of 0.22 $\mu$m, thereby obtaining yellow, magenta, cyan and black inks (4)-Y, (4)-M, (4)-C and (4)-Bk.

(4)-Y:

| | |
|---|---|
| C.I. Direct Yellow 86 | 3.0 parts |
| Thiodiglycol | 10.0 parts |
| Glycerol | 7.0 parts |
| Urea | 7.0 parts |
| Acetylenol EH (trade name, product of Kawaken Fine Chemicals Co., Ltd.) | 1.0 part |
| Water | Balance. |

(4)-M:

The same composition as in (4)-Y except that the dye was changed to 4 parts of C.I. Acid Red 289.

(4)-C:

The same composition as in (4)-Y except that the dye was changed to 4 parts of C.I. Acid Blue 9.

(4)-Bk:

The same composition as in (4)-Y except that the dye was changed to 4.5 parts of C.I. Food Black 2.

Using the Printing Papers 4-1 to 4-9 and inks thus obtained, color images were formed by means of an ink-jet printing apparatus equipped with printing heads of a drop-on-demand type ink-jet system having 14 nozzles per mm in which droplets of inks are ejected by applying thermal energy, thereby evaluating the resulting images. Printing conditions were as follows:

Drive frequency: 6 kHz.

Ejection quantity: 45 pl

Printing density: 9 nl/mm$^2$ at the greatest per single color.

The degree of show-through of each of the printing paper samples was determined in accordance with the above-described method. An ink BJI-201 Bk (product of Canon Inc.) was used as the testing liquid. The application of the testing liquid was performed by charging the testing liquid into the printing head of the above printing apparatus and then conducting solid printing in the greatest printing density three times so as to overlap each other. The results are shown in Table 9.

The evaluation of the printed images was conducted on both sides of each printing paper sample in accordance with the following methods. The results are shown in Table 9.

1) Optical Density:

A solid print of 100% duty was formed with each of the black, yellow, cyan and magenta inks. After the print sample was left over for 12 hours, its reflection density was measured by means of a reflection densitometer (Macbeth RD918, trade name, manufactured by Macbeth Co.).

2) Resistance to Bleeding:

Solid areas of black, yellow, magenta, cyan, blue, green and red were printed in contiguity with one another. The thus-obtained print sample was visually observed as to the degree of bleeding occurred at boundaries between the respective colors, and the resistance to bleeding was ranked as AA where each boundary was legible as a straight line, A where the boundary was distinct, but its linearity was somewhat poor, C where the inks mixed with each other, and so the boundary therebetween was illegible, or B where the degree of bleeding was between the ranks A and C.

3) Suitability for Plain Paper:

The suitability of each printing paper sample for plain paper was ranked as A where it was near a feeling of plain paper to look at and writable with mechanical pencils, ball point pens, felt-tip pens, etc. like plain paper, or C where it was not so good.

4) Double-side Printability:

Using two printers BJC-600J and BJC-400J (both, trade names, manufactured by Canon Inc.), full-color printing was conducted on one side of each printing paper sample. Thereafter, printing was also conducted on the other side similarly. Besides, after monochromatic printing including solid prints was conducted on one side of the printing paper by means of a printer BJ-220JS (trade name, manufactured by Canon Inc.), the same printing was also conducted on the other side. The double-side printability was visually evaluated at a distance of 25 cm and ranked as A where bright images were formed on both sides without being affected by the image formed on the opposite side, or C where exudation of ink from the opposite side or color mixing of inks was recognized at unprinted white portions or printed areas.

TABLE 9

| | | | | Results of evaluation | | | | | | | |
|---|---|---|---|---|---|---|---|---|---|---|---|
| | No. of printing | Degree of show- | | Optical density | | | | Resistance to | Suitability for plain | Double-side printability | |
| | paper | through | Opacity | Black | Cyan | Magenta | Yellow | bleeding | paper | Color | Monochro |
| Ex. 4 | 4-1 | 0.17 | 88% | 1.42 | 1.42 | 1.46 | 1.37 | A | A | A | A |
| | | 0.17 | | 1.41 | 1.44 | 1.46 | 1.37 | A | A | A | A |
| Ex. 4 | 4-2 | 0.16 | 88% | 1.42 | 1.42 | 1.46 | 1.37 | A | A | A | A |
| | | 0.17 | | 1.42 | 1.42 | 1.46 | 1.36 | A | A | A | A |
| Ex. 4 | 4-3 | 0.21 | 92% | 1.38 | 1.42 | 1.43 | 1.31 | A | A | A | A |
| | | 0.22 | | 1.39 | 1.41 | 1.43 | 1.30 | A | A | A | A |
| Ex. 4 | 4-4 | 0.18 | 92% | 1.42 | 1.46 | 1.54 | 1.33 | A | A | A | A |
| | | 0.19 | | 1.43 | 1.46 | 1.51 | 1.34 | A | A | A | A |
| Comp. | 4-5 | 0.30 | 82% | 1.18 | 1.17 | 1.32 | 1.16 | C | A | C | A |
| Ex. 4-1 | | 0.29 | | 1.17 | 1.17 | 1.30 | 1.18 | C | A | C | A |
| Ref. | 4-6* | 0.36 | 92% | 1.27 | 1.28 | 1.31 | 1.15 | A | A | C | C |
| Ex. 4-1 | | 0.36 | | 1.28 | 1.27 | 1.30 | 1.15 | A | A | C | C |
| Comp. | 4-7* | 0.30 | 92% | 1.38 | 1.39 | 1.44 | 1.31 | A | C | C | C |
| Ex. 4-2 | | 0.39 | | 1.09 | 1.12 | 1.17 | 1.06 | C | A | C | C |
| Comp. | 4-8 | 0.00 | 99% | 1.48 | 1.49 | 1.56 | 1.38 | C | C | A | A |
| EX. 4-3 | | 0.00 | | 1.48 | 1.49 | 1.56 | 1.38 | C | C | A | A |
| Ref. | 4-9 | 0.31 | 93% | 1.12 | 1.12 | 1.15 | 1.07 | B | A | A | A |
| Ex. 4-2 | | 0.30 | | 1.13 | 1.14 | 1.13 | 1.09 | B | A | A | A |

Evaluation was conducted on both sides of each printing paper sample.
*The upper rows of Printing Paper 4–6 and 4–7 show the results as to the coated surface.

As apparent from Example 4, Comparative Examples 4-1 to 4-3 and Referential Examples 4-1 and 4-2, the use of the printing paper according to the present invention in color ink-jet printing made it possible to provide very bright images high in optical density and free of bleeding. Further, in the printing paper according to the present invention, a good image can be formed even when printing is conducted on either surface. Besides, since the printing paper according to the present invention is not provided with a special coating unlike the prior art, it undergoes no defective paper feed even when it is used many times in any printing apparatus, has a feeling comparable to plain paper and is good in writing quality upon writing with a pencil.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. Printing paper comprising pulp fibers and a filler, wherein fine particles having a particle diameter of from 5 to 200 nm, a binder and a cationic substance are held on the pulp fibers in such a way that all pulp fibers exposed on both surfaces of the printing paper are covered with the fine particles in a state that their fibrous form is retained, and wherein the fine particles are applied to the printing paper in an amount of from 0.1 to 6 g/m$^2$ and the cationic substance is applied to the printing paper in an amount of from 0.1 to 6 g/m$^2$, and wherein the cationic substance comprises a cationic substance having a molecular weight of 1000 or lower and a cationic substance having a molecular weight of 2000 or higher.

2. An ink-jet printing process comprising the step of applying droplets of an ink to the printing paper according to claim 1 to conduct printing.

3. The ink-jet printing process according to claim 2, wherein color printing is conducted with three color inks of yellow, cyan and magenta colors.

4. The ink-jet printing process according to claim 3, wherein a black ink is used in addition to the three color inks.

5. The ink-jet printing process according to claim 4, wherein the surface tension of the black ink is higher than those of the color inks.

6. The ink-jet printing process according to claim 5, wherein the surface tension of the black ink falls within the range of from 45 to 60 dyn/cm, and the surface tensions of the yellow, cyan and magenta inks each fall within the range of from 25 to 40 dyn/cm.

7. The ink-jet printing process according to claim 2, wherein the ink droplets are ejected by a system in which thermal energy is applied to an ink to eject droplets of the ink.

8. An ink-jet printing process comprising using an ink-jet printing apparatus comprising feeding means adapted to come into contact with one surface of a printing paper sheet among a stack of printing paper sheets to feed the printing paper sheet to a printing position, and means for separating the printing paper sheet from the stack of printing paper sheets to conduct printing on the printing paper according to claim 1.

9. The ink-jet printing process according to claim 8, wherein inks to be used consist of color inks of yellow, cyan and magenta, and a black ink.

10. The printing paper according to claim 1, wherein the degree of show-through measured with a liquid having a surface tension of 30±2 dyn/cm falls within the range of from 0.05 to 0.25.

11. An ink-jet printing process comprising the step of applying droplets of an ink to the printing paper according to claim 10 to conduct printing.

12. The ink-jet printing process according to claim 11, wherein inks to be used consist of color inks of yellow, cyan and magenta, and a black ink.

13. The printing paper according to claim 1, wherein to filler is kaolin.

14. The printing paper according to claim 1, which has a water extraction pH of 6 or higher.

15. the printing paper according to claim 1, which has a water extraction pH of 7 or higher.

16. The printing paper according to claim 14 or 15, which has a water extraction pH of 10 or lower.

17. The printing paper according to claim 14 or 15, which has a water extraction pH of 9 or lower.

18. The printing paper according to claim 1, which has a Stöckigt sizing degree of from 10 to 40 seconds.

19. The printing paper according to claim 1, which has a basis weight of from 50 to 200 g/m$^2$.

* * * * *

UNITED STATES PATENT AND TRADEMARK OFFICE

CERTIFICATE OF CORRECTION

PATENT NO. : 6,475,601 B1
DATED : November 5, 2002
INVENTOR(S) : Sakaki et al.

It is certified that error appears in the above-identified patent and that said Letters Patent is hereby corrected as shown below:

Title page,
Item [56], References Cited, FOREIGN PATENT DOCUMENTS,
"6063190" should read -- 60-63190 --;
"0725131" should read -- 7-25131 --;
"0725132" should read -- 7-25132 --; and
"07025131" should be deleted.

Column 1,
Line 39, "and." should read -- and --;
Line 40, "in-the" should read -- in the --; and
Line 54, "use" should read -- be used --.

Column 3,
Line 41, "invention" should read -- invention. --.

Column 5,
Line 20, "and-optical" should read -- and optical --.

Column 6,
Line 24, "hundreds" should read -- hundreds of --.

Column 7,
Line 50, "St" should be deleted;
Line 51, "öckigt" should read -- Stöckigt --; and
Line 59, "a-range" should read -- a range --.

Column 10,
Line 6, "and-cyan" should read -- and cyan --;
Line 27, "rubber.)" should read -- rubber) --;
Line 28, "the-form" should read -- the form --; and
Line 60, "image-formed" should read -- image formed --.

UNITED STATES PATENT AND TRADEMARK OFFICE

CERTIFICATE OF CORRECTION

PATENT NO. : 6,475,601 B1
DATED : November 5, 2002
INVENTOR(S) : Sakaki et al.

It is certified that error appears in the above-identified patent and that said Letters Patent is hereby corrected as shown below:

Column 16,
Line 3, “roller” should read -- rollers --.

Column 18,
Line 65, “EXAMPLES” should read -- EXAMPLE --.

Column 19,
Line 5, “EXAMPLES” should read -- EXAMPLE --;
Line 61, “captures” should read -- capture --; and
Line 64, “particle” should read -- particles --.

Column 20,
Line 24, “D-were” should read -- D were --.

Column 22,
Line 53, “mixed” should read -- mixed with --.

Column 23,
Lines 49 and 56, “Examples” should read -- Example --; and
Lines 51, 53 and 61, “are” should read -- is --.

Column 24,
Line 44, “are” should read -- is --.

Column 25,
Line 9, “coating” should read -- Coating --.

Column 26,
Line 34, “Examples” should read -- Example --; and
Line 42, “alcohol” should read -- alcohol 4 parts --, and “4 parts name,” should read -- name, --.

UNITED STATES PATENT AND TRADEMARK OFFICE

CERTIFICATE OF CORRECTION

PATENT NO. : 6,475,601 B1
DATED : November 5, 2002
INVENTOR(S) : Sakaki et al.

It is certified that error appears in the above-identified patent and that said Letters Patent is hereby corrected as shown below:

Column 28,
Line 66, “Per” should read -- per --.

Column 30,
Line 38, “(product” should read -- product --.

Column 35,
Line 11, “to” should read -- the --.

Column 36,
Line 1, “the” should read -- The --.

Signed and Sealed this

Twenty-third Day of September, 2003

JAMES E. ROGAN
*Director of the United States Patent and Trademark Office*